US008465062B2

(12) United States Patent
Weinerman et al.

(10) Patent No.: US 8,465,062 B2
(45) Date of Patent: Jun. 18, 2013

(54) ARMORED VEHICLE DOOR HARDWARE PROVIDING ACCESS, EGRESS, RESCUE AND SECURITY

(75) Inventors: Lee S. Weinerman, Medina, OH (US); Scott A. Arthurs, Brunswick, OH (US); David J. Wolf, Batavia, OH (US); Gerald M. Szpak, North Royalton, OH (US); John W. Jostworth, Cincinnati, OH (US)

(73) Assignees: The Eastern Company; BAE Systems Survivability Systems, LLC

( * ) Notice: Subject to any disclaimer, the term of this patent is extended or adjusted under 35 U.S.C. 154(b) by 1630 days.

(21) Appl. No.: 11/978,425

(22) Filed: Oct. 29, 2007

(65) Prior Publication Data

US 2012/0167476 A1 Jul. 5, 2012

Related U.S. Application Data

(60) Provisional application No. 60/965,443, filed on Aug. 20, 2007.

(51) Int. Cl.
*E05C 1/02* (2006.01)
*E05C 1/06* (2006.01)
*E05C 1/08* (2006.01)

(52) U.S. Cl.
USPC ..... 292/137; 292/138; 292/163

(58) Field of Classification Search
CPC ..... E05B 65/006; E05B 63/20; E05B 15/101; E05B 65/1053
USPC ..... 292/137, 138, 140, 139, 163, 169, 292/173, 175; 70/92, 465

See application file for complete search history.

(56) References Cited

U.S. PATENT DOCUMENTS

| | | | | | |
|---|---|---|---|---|---|
| 164,780 | A | * | 6/1875 | Stow | 292/173 |
| 306,554 | A | * | 10/1884 | Titley | 292/173 |
| 797,425 | A | * | 8/1905 | Hagg | 292/164 |
| 1,104,460 | A | * | 7/1914 | Wesolowski | 292/169.21 |
| 1,216,584 | A | * | 2/1917 | Mast | 292/173 |
| 1,218,845 | A | * | 3/1917 | Dziegielewski | 292/169.22 |

(Continued)

FOREIGN PATENT DOCUMENTS

| | | | |
|---|---|---|---|
| GB | 2075588 | A | * 11/1981 |
| GB | 2232194 | A | * 12/1990 |

OTHER PUBLICATIONS

Eberhard MFG. Co, Cleveland, OH 44149 © 2000 (One Page) Drawing Showing #2390-AM R/L Lock for School Bus.

(Continued)

*Primary Examiner* — Carlos Lugo
*Assistant Examiner* — Nathan Cumar
(74) *Attorney, Agent, or Firm* — David A. Burge

(57) ABSTRACT

A latch, latching system and other components are disclosed that are particularly well suited for use with the heavy doors of armored military vehicles. Some component embodiments are usable in normal and emergency modes to provide access, entry, egress and rescue through vehicle door openings. Included among the disclosed components are latches having separate operating components that can be used to retract spring projected latch bolts and that usable advantageously in pairs and readily reconfigurable for use on left, right, front and rear doors of a vehicle at locations where door thicknesses differ. Also disclosed are operating linkages intended to extend exteriorly of door armor to turn shafts to operate latches situated interiorly of the door armor.

19 Claims, 30 Drawing Sheets

U.S. PATENT DOCUMENTS

| | | | | | |
|---|---|---|---|---|---|
| 1,325,970 | A | * | 12/1919 | Zwierzina | 292/173 |
| 1,603,722 | A | * | 10/1926 | Stanley | 292/255 |
| 2,735,706 | A | | 2/1956 | Pelcin | 292/34 |
| 2,741,504 | A | * | 4/1956 | Dale | 292/255 |
| 2,764,440 | A | * | 9/1956 | Marko | 292/173 |
| 2,862,750 | A | * | 12/1958 | Minke | 292/172 |
| 2,900,204 | A | | 8/1959 | Pelcin | 292/173 |
| 2,928,690 | A | * | 3/1960 | Larson | 292/336.3 |
| 3,209,563 | A | | 10/1965 | Pelcin | 70/146 |
| 3,209,564 | A | | 10/1965 | Pelcin | 70/148 |
| 3,357,734 | A | | 12/1967 | Pastva, Jr. | 292/165 |
| 3,389,932 | A | | 6/1968 | Pastva, Jr. | 292/173 |
| 3,449,005 | A | | 6/1969 | Pastva, Jr. | 292/173 |
| 3,807,203 | A | | 4/1974 | Larsen | 70/149 |
| 3,909,051 | A | | 9/1975 | Nakai | 292/166 |
| 3,953,061 | A | | 4/1976 | Hansen et al. | 292/5 |
| 4,193,619 | A | | 3/1980 | Jerila | 292/168 |
| 4,231,597 | A | | 11/1980 | Pelcin | 292/16.4 |
| 4,312,202 | A | | 1/1982 | Pastva, Jr. | 70/472 |
| 4,312,205 | A | | 1/1982 | Reed et al. | 70/472 |
| 4,320,642 | A | | 3/1982 | Pastva, Jr. | 70/472 |
| 4,641,865 | A | | 2/1987 | Pastva | 292/5 |
| 4,703,961 | A | | 11/1987 | Weinerman et al. | 292/216 |
| 4,892,338 | A | | 1/1990 | Weinerman et al. | 292/35 |
| 4,896,906 | A | | 1/1990 | Weinerman et al. | 292/48 |
| 5,069,491 | A | | 12/1991 | Weinerman et al. | 292/48 |
| 5,074,611 | A | | 12/1991 | Newkirk | 296/146 |
| 5,117,665 | A | * | 6/1992 | Swan et al. | 70/264 |
| 5,663,520 | A | | 9/1997 | Ladika et al. | 89/36.08 |
| 5,820,177 | A | * | 10/1998 | Moon | 292/335 |
| 5,884,948 | A | | 3/1999 | Weinerman et al. | 292/216 |
| 6,363,830 | B1 | | 4/2002 | Gonzalez | 89/36.01 |
| 6,471,260 | B1 | | 10/2002 | Weinerman et al. | 292/216 |
| 6,802,543 | B1 | | 10/2004 | Wakefield | 292/48 |
| 7,270,352 | B1 | * | 9/2007 | Stuart | 292/255 |

OTHER PUBLICATIONS

Eberhard MFG. Co, Cleveland, OH 44149 © 2007 Catalog#112 p. 241 & Drawing Showing #25-C Door Control for School Bus.

* cited by examiner

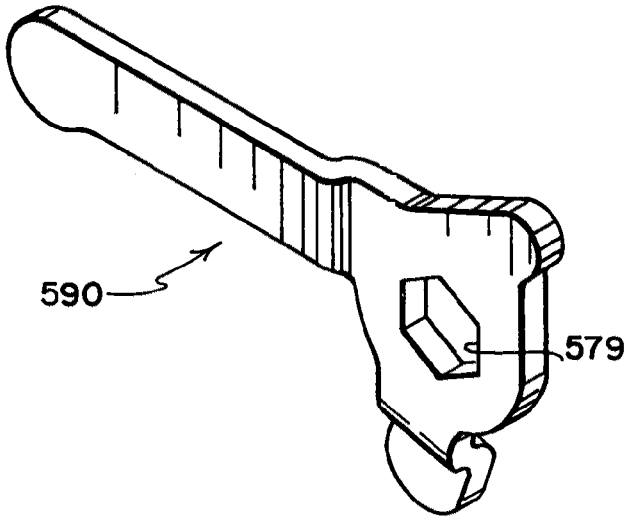
FIG. 25
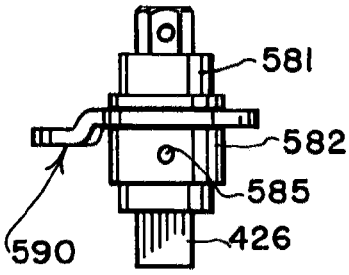
FIG. 26
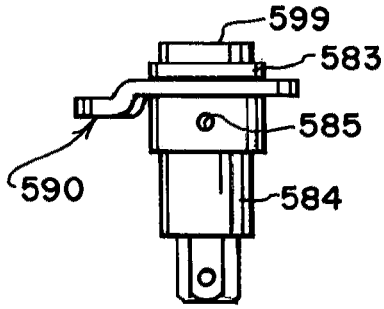
FIG. 29
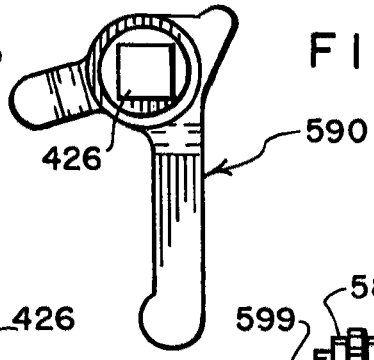
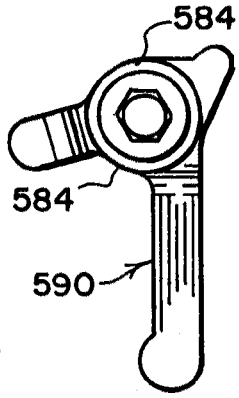
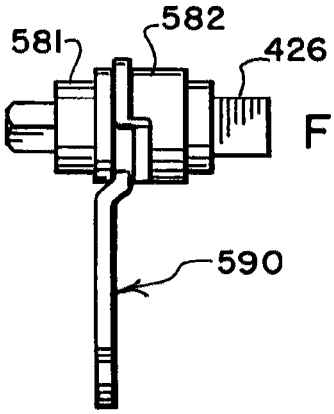
FIG. 27
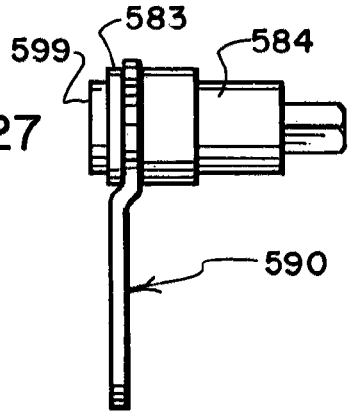
FIG. 30
FIG. 28
FIG. 31

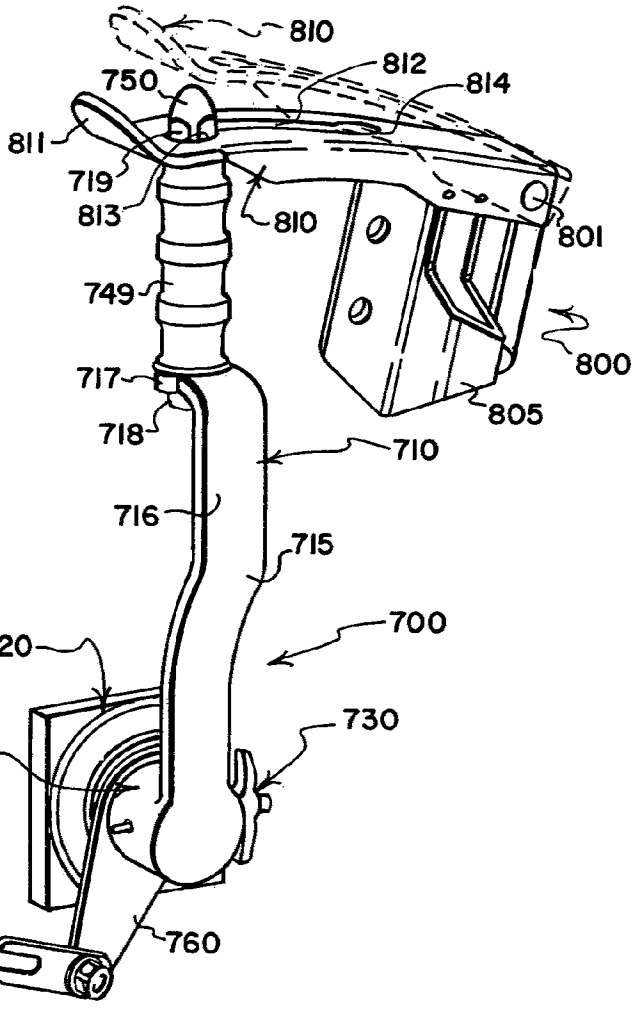
FIG. 43
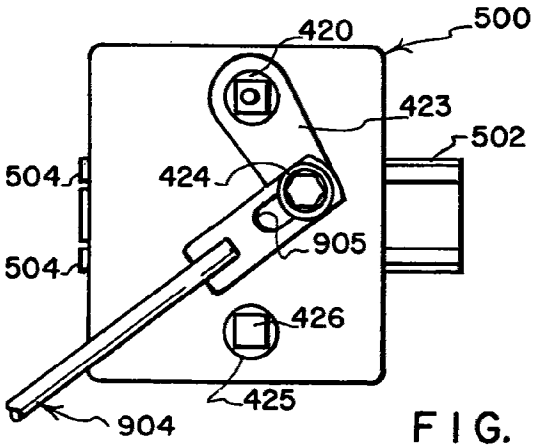
FIG. 44
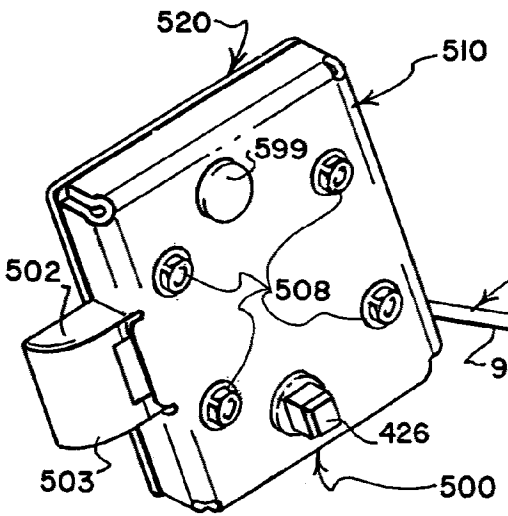

ARMORED VEHICLE DOOR HARDWARE PROVIDING ACCESS, EGRESS, RESCUE AND SECURITY

REFERENCE TO PROVISIONAL APPLICATION

This application claims the benefit of U.S. provisional application Ser. No. 60/965,443 filed Aug. 20, 2007 by Lee S. Weinerman et al, the disclosure of which is incorporated herein by reference.

BACKGROUND

Although the focus of this application is primarily on heavy duty latching systems and components that are particularly well suited for use with the heavy doors of armored military vehicles known as "Up-Armored Humvees" (including latches, latch operating handles and other components capable of being used in "normal" and "emergency" modes to provide access, entry, egress and rescue), much of what is disclosed herein also can be used to augment, improve and enhance the capability, durability and performance of lighter duty hardware systems and components used in a wide variety of other applications including commercial, industrial and residential uses that have nothing to do with armored doors of military vehicles.

Likewise, although the present application discloses a complex arrangement of linkage connected, slam-capable latches having spring-projected slide bolts that can retract individually or in unison in response to normal and emergency modes of use of differently configured interior and exterior operating handles, many of the improvements, enhancements and advancements described herein also can be used to upgrade the capabilities and to lengthen the service lives of simpler closure-control systems and lighter-duty hardware components such as latches, locks, operating handles and connecting links used with the doors, drawers and lids of commercial and industrial cabinets and tool boxes.

SUMMARY OF THE DISCLOSURE

To reasonably limit the length of this summary, mention is made here of only a selected few of the many features that are offered by and derive from the sizable number of invention embodiments disclosed in this provisional application. Because mention is made here of only a few of the many features disclosed in this application, this summary is not to be interpreted as limiting the subject matter that is expected to be addressed by, nor the scope of the claims expected to be included in this application or in the spectrum of applications that may eventually be filed in the U.S. Patent and Trademark Office or elsewhere hereafter claiming at least some benefit from the filing date of the referenced provisional application.

To latch and lock in closed position the heavy door of an armored vehicle, some embodiments disclosed herein provide the door with a pair of heavy duty slam-capable latch assemblies mounted on the door at locations spaced from each other and from an axis about which the door swings when pivoting between open and closed positions.

To minimize the possibility that an attack on an armored vehicle might cause damage to, or might cause unlatching of the latch assemblies that hold each armored door closed, some embodiments require that the latch assemblies be mounted on their associated door at locations interior to the heavy armor plate that lines the associated door.

To ensure that the slide bolts of the latch assemblies that hold closed a particular armored vehicle door operate independently to latchingly retain the associated armored door in its closed position, some embodiments provide the slide bolt of each latch assembly with a separate spring (at least one per slide bolt) that independently biases only its associated slide bolt toward the extended position of the slide bolt. Stated in another way, the slide bolts of the latches carried on each door are separately, independently biased by different springs to extended positions for latchingly retaining the door closed—and this is true even if the door is provided with other components that can cause the latch bolts to retract concurrently or in a coordinated manner. Thus, if the slide bolt biasing spring of one of the two latches holding a particular door closed should break or otherwise fail to cause the associated slide bolt to extend, the spring that operates the other slide bolt should nonetheless cause its associated slide bolt to extend and latchingly retain the door in its closed position. Accordingly, each of the latch assemblies that holds a particular door closed will be understood to "back up" the latching action of the other latch assembly.

To ensure that the spring-projected latch bolts of the latches that hold an armored door closed can be retracted not only in normal modes of operation but also in emergency modes, some embodiments permit an interior operating handle to be released from its normal mount and used in an emergency mode coupled to one or more emergency connectors to operate emergency components of the latches to retract the latch bolts; and some embodiments also provide emergency connectors or connection points for emergency attachment of an interior operating handle at locations inside and outside the doors of an armored vehicle, by which arrangement the internal handle can be used by occupants of a vehicle to escape from their vehicle or to open another vehicle to assist its occupants with escape or rescue.

In some embodiments, the use of emergency latch operating components to retract latch bolts requires no concurrent movement of components used normally to retract the latch bolts—thus, if normal operating components are damaged, broken or jammed, this usually does not prevent the latch bolts from being retracted by the emergency latch operating components. In some embodiments, once the latch bolts have been retracted by turning the emergency latch operating components, the latch bolts are retained in their retracted positions rather than permitted to return (as they normally would under the influence of latch springs that bias the slide bolts toward their extended positions). By this arrangement, the retracted latch bolts are prevented from relatching after they have been retracted as the result of using emergency operating components of the latches.

To enhance the safety of personnel being transported by an armored vehicle, some embodiments disclosed herein provide the vehicle with armored doors that each carry at least two latch assemblies which are interconnected by links carried exteriorly of the armor of the door so that, if the links should be severed or should become separated from the door due to explosive attack or the like, the armor of the door will prevent the links or elements thereof from entering the passenger compartment as shrapnel that causes injury to the occupants of the vehicle.

To concurrently operate such latch assemblies as may be carried on the door of an armored vehicle (so the door can be unlatched and opened in a "normal" mode when the latching system of the door is undamaged and the door is able to pivot from closed to open positions), some of the embodiments disclosed herein provide the door with both an internal operating handle and an external operating handle, either of which can be turned to move links and other latching system components to concurrently retract the latch bolts of the latch assemblies. In some embodiments, using the internal handle to normally open the door is effected by turning the interior handle from a normal or non-operated position to an operated or unlatched position, and this causes a series of drive components (including shafts that extend through the armor of the door, and linkage elements situated interiorly and exteriorly of the door armor) to move in unison to cause the spring projected bolts of the latch assemblies to retract so the door can swing open about its pivot axis. Likewise, in some embodiments, using the external handle to normally open the door also is a simple matter of turning the exterior handle from a normal non-operated position to an operated or unlatched position, and this causes the drive components to move in unison to retract the latch bolts.

To individually operate such latch assemblies as may be carried on the door of an armored vehicle (so the door can be unlatched and opened in an "emergency" mode so occupants can escape or be rescued when, for example, the vehicle may have been attacked, may be significantly damaged, and possibly is on fire), some of the embodiments disclosed herein provide each of the latch assemblies with emergency operating components that can be accessed and turned from inside and from outside the vehicle to retract the latch bolts one at a time without requiring normal operating components (i.e., components that normally are used to retract the latch bolts concurrently as described in the paragraph just above) to move, or to even be capable of moving—which is to say that the emergency operating components are capable of retracting the latch bolts even if the normal operating components are completely unable to move or to coordinate the movement of the latch bolts. Some embodiments also provide the latches with latch bolt retainers that cause the retracted latch bolts to be retained in their retracted positions once they have been retracted as the result of using the emergency operating components—an arrangement that prevents the retracted latch bolts from returning to their latched positions (which might prevent escape or rescue of occupants).

To permit the escape or rescue of vehicle occupants who may be unable to open a door of the vehicle or who may be trapped in the vehicle because neither the "normal" nor the "emergency" operating components are capable of retracting the latch bolts holding closed a particular door, some embodiments mount the exterior handle so very securely on the door that tow lines from other vehicles can be connected to the exterior handle to pull open the door by brute force of such magnitude that the latch bolts which are holding the door closed can be caused to release their latched engagement with associated strikes or strike formations of the vehicle. Some of these embodiments also provide the exterior handle with a heavy steel ring to which tow lines or winch cables can easily be attached if the door is to be pulled open by brute force.

To lock the door of the vehicle from the interior of the vehicle, some embodiments permit the interior handle to be pivoted to, and to be releasably retained in, a locked position; and, when the interior handle is in the locked position, these embodiments prevent the exterior handle from being turned to operate the latches that hold the door closed. To lock the door from outside the vehicle, some embodiments permit a padlock to be installed on the exterior handle in a way that prevents the exterior handle from being turned to unlock the latches; and, if a padlock is installed on the exterior handle, these embodiments nonetheless permit the internal handle to be turned to release the latches so occupants of the vehicle can still open the door and exit the vehicle.

In some embodiments, a safety catch mechanism is provided to engage the upper end region of the interior handle to releasably retain the interior handle in one or the other of the non-operated and locked positions of the handle if the handle has been pivoted to either of these positions while the safety catch is biased into engagement with the upper end region of the interior handle. By this arrangement, unintended unlatching and unintended unlocking movements of the interior handle are minimized. And, to further ensure that the interior handle is not unintentionally moved from its locked position, some embodiments require that, in order for the safety catch to be disengaged from the internal handle to permit movement of the interior handle from its locked position, the safety catch must be moved with greater force or through a greater distance or range of motion than is required to disengage the safety catch from the internal handle for movement when the handle is in its non-operated position.

In some embodiments, components that connect interior and exterior handles with the door-carried latches include what are referred to as "lost motion connections" that enable either of the interior and exterior handles to be turned to release the associated pair of door latches without causing any corresponding movement of the other of the interior and exterior handles. Thus, only one of the handles needs to move to its operated position to retract the slide bolts of the latches; and, the handle on the opposite side of the door can remain in a non-operated position while a selected handle is turned to operate the latches.

In some embodiments, connecting rod links that transmit linear movements among the door-carried handles and latches are provided with turnbuckles that can be turned to adjust and fine-tune the lengths of the connecting rods so proper operation of door-carried components can be attained and maintained even if certain of the components incur damage due to attack. Likewise, in some embodiments, shafts that transmit turning movements through the armor of a door (so latches will operate in response to the turning of handles) are journaled for smooth operation by bearing blocks which are adjustably mounted on the door so proper operation of these door-carried components can be attained and maintained. The bearing blocks can be adjustably repositioned and shimmed as may be needed to provide, maintain or re-establish proper alignment of relatively movable components should an explosion or other source of shock cause the shafts to fail to turn smoothly in their bearing blocks.

To ensure that heavy armored doors align properly with their door openings during closure of the doors, and to hold the closed doors in proper alignment with their door openings, some embodiments provide alignment devices (having components mounted on the doors and on vehicle structure that extends about the door openings) with formations that interengage in something of a wedging action as the doors close. In some embodiments, the alignment devices preferably are stationed at locations mid-way between the latches of the associated door to help ensure that the slide bolts of the latches remain properly aligned with their associated strikes to keep the latch bolts latched when the door is closed.

The modular nature of the many aforedescribed components, their versatility and their adjustability enable many of the components disclosed herein to be used on armored doors of a wide variety of sizes and shapes. Latching systems can be assembled utilizing the disclosed components to provide a particular door with almost any desired number of the heavy duty latch assemblies and to retain closures of almost any desired size and shape securely in closed positions.

BRIEF DESCRIPTION OF THE DRAWINGS

The foregoing and other features will be better understood from the detailed description that follows, taken together with the accompanying drawings.

In the accompanying drawings:

FIG. 25 is a perspective view of a generally L-shaped left tumbler lever of the type used in the latch assembly of FIG. 16;

FIGS. 26-28 are top, side and end elevational views, respectively, showing how the L-shaped left tumbler lever of FIG. 25 is combined with other tumbler parts such as are illustrated in FIG. 15 or 16 to form an emergency or rescue operating tumbler for one of the latches depicted in FIGS. 5-14;

FIGS. 29-31 are top, side and end elevational views, respectively, showing how the L-shaped left tumbler lever of FIG. 25 is combined with other tumbler parts such as are illustrated in FIG. 15 or 16 to form a normal operating tumbler for one of the latches depicted in FIGS. 5-14;

FIG. 43 is a perspective view showing the internal operating handle in its normal, non-operated position and being retained therein by a safety catch assembly that engages an upper end region of the internal operating handle, with broken lines illustrating how the safety catch can be pivoted out of engagement with the upper end region of the internal operating handle;

FIG. 44 is a side elevational view showing the opposite side of the latch assembly depicted in FIG. 43, with the depicted position of a link that connects with the internal operating handle doing nothing to keep the exterior operating handle from turning an arm of the depicted latch assembly to the operated position of the arm as shown in FIG. 48;

DETAILED DESCRIPTION

Figure 1:
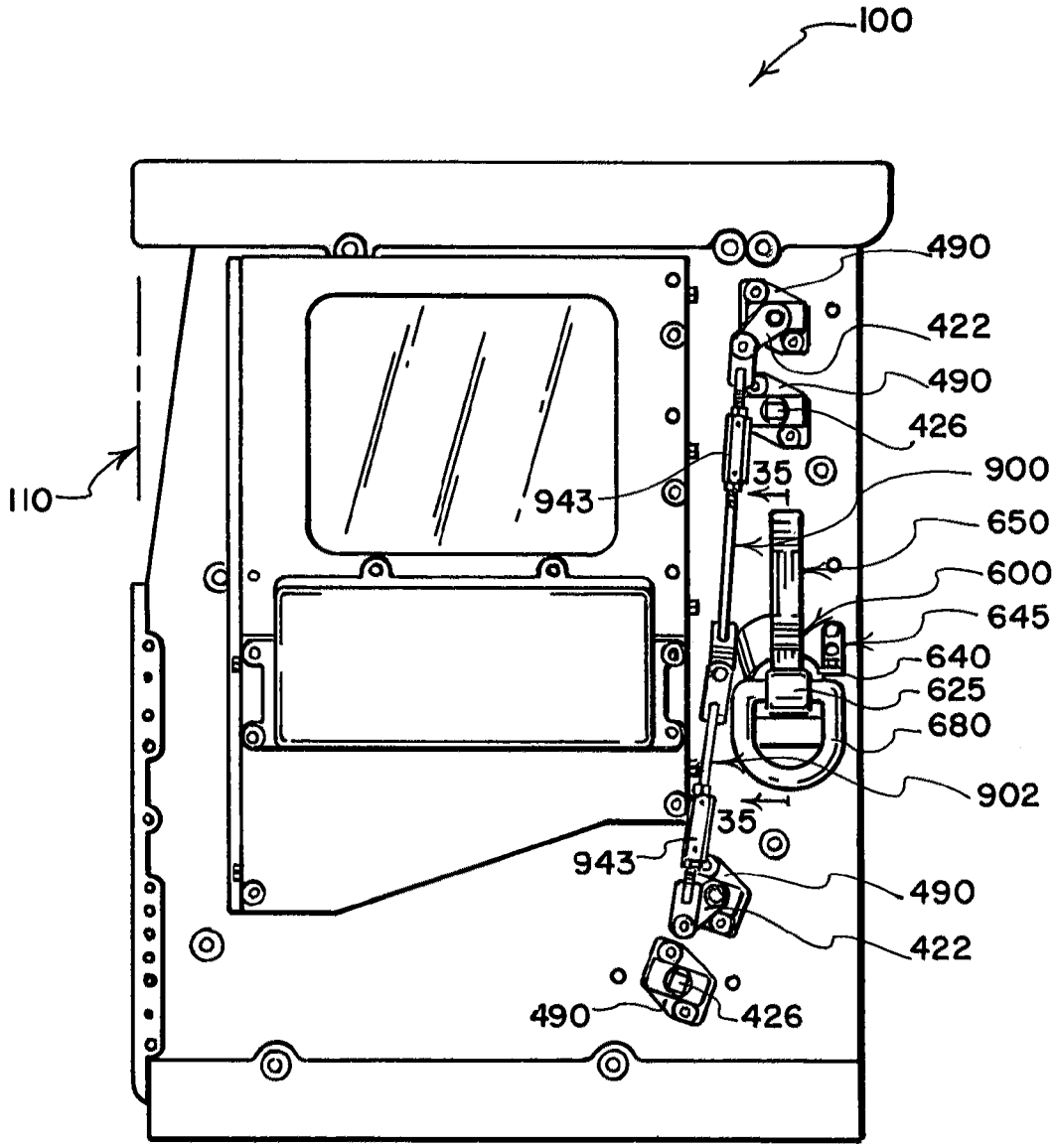
FIG. 1 is an exterior side view of selected portions of a left front (driver's side) door of an armored military vehicle, with the depicted exterior operating handle in its normal, non-operated position.
Figure 2:
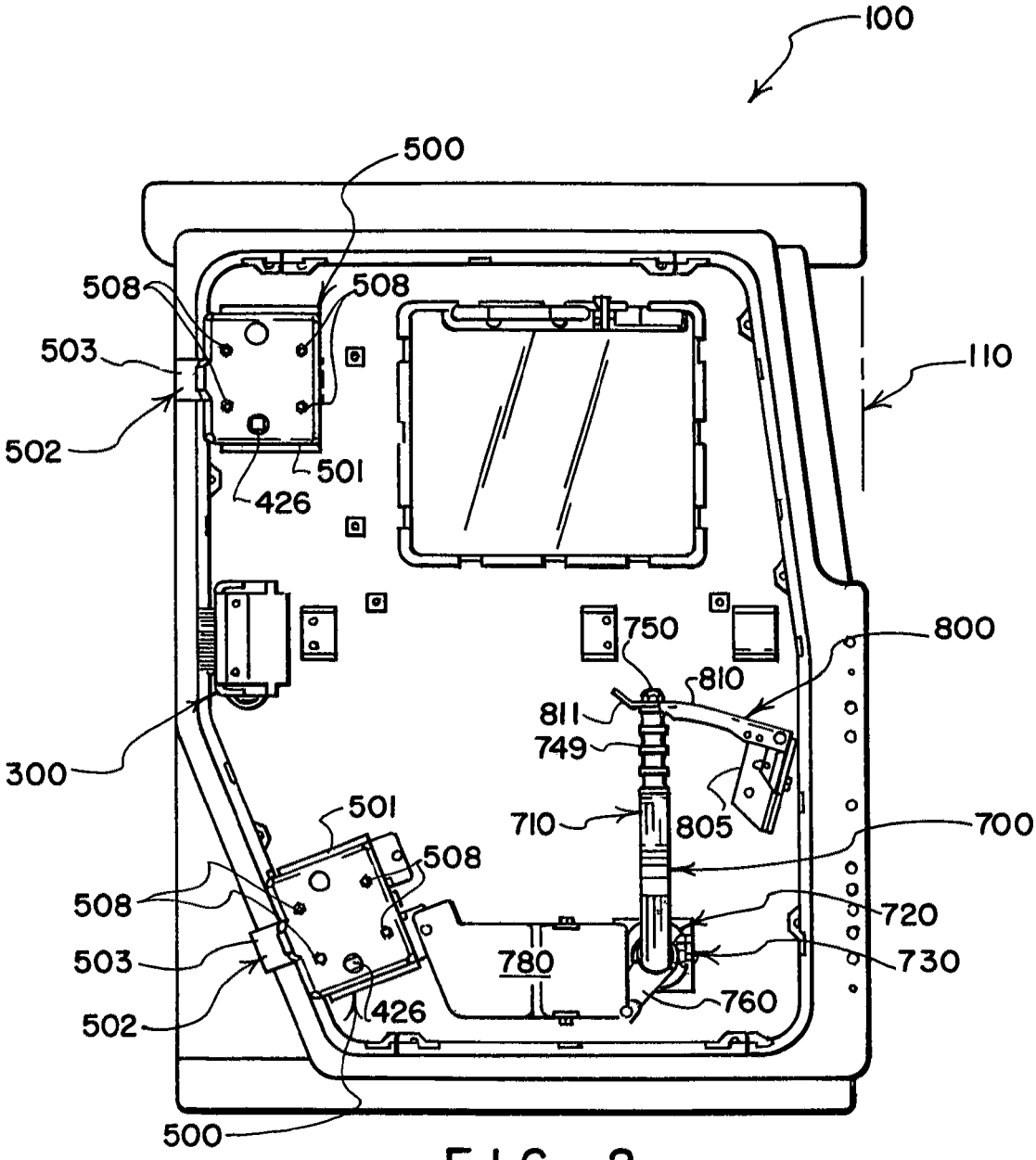
FIG. 2 is an interior side view thereof, with the depicted interior operating handle in its normal non-operated position.

Shown in FIGS. 1 and 2 are exterior and interior portions, respectively, of a left front or driver's side door 100 of a multipurpose armored utility vehicle, for example of the type used by military personnel in hostile and dangerous environs. The term "Up-Armored Humvee" is sometimes used to refer to military vehicles of this type. Just as the left front door 100 closes a left door opening at the front of the vehicle's passenger compartment, a similarly configured door (not shown) having a configuration that substantially mirrors that of the left front door 100 is provided to close a right door opening at the front of the vehicle's passenger compartment.

Figure 3:
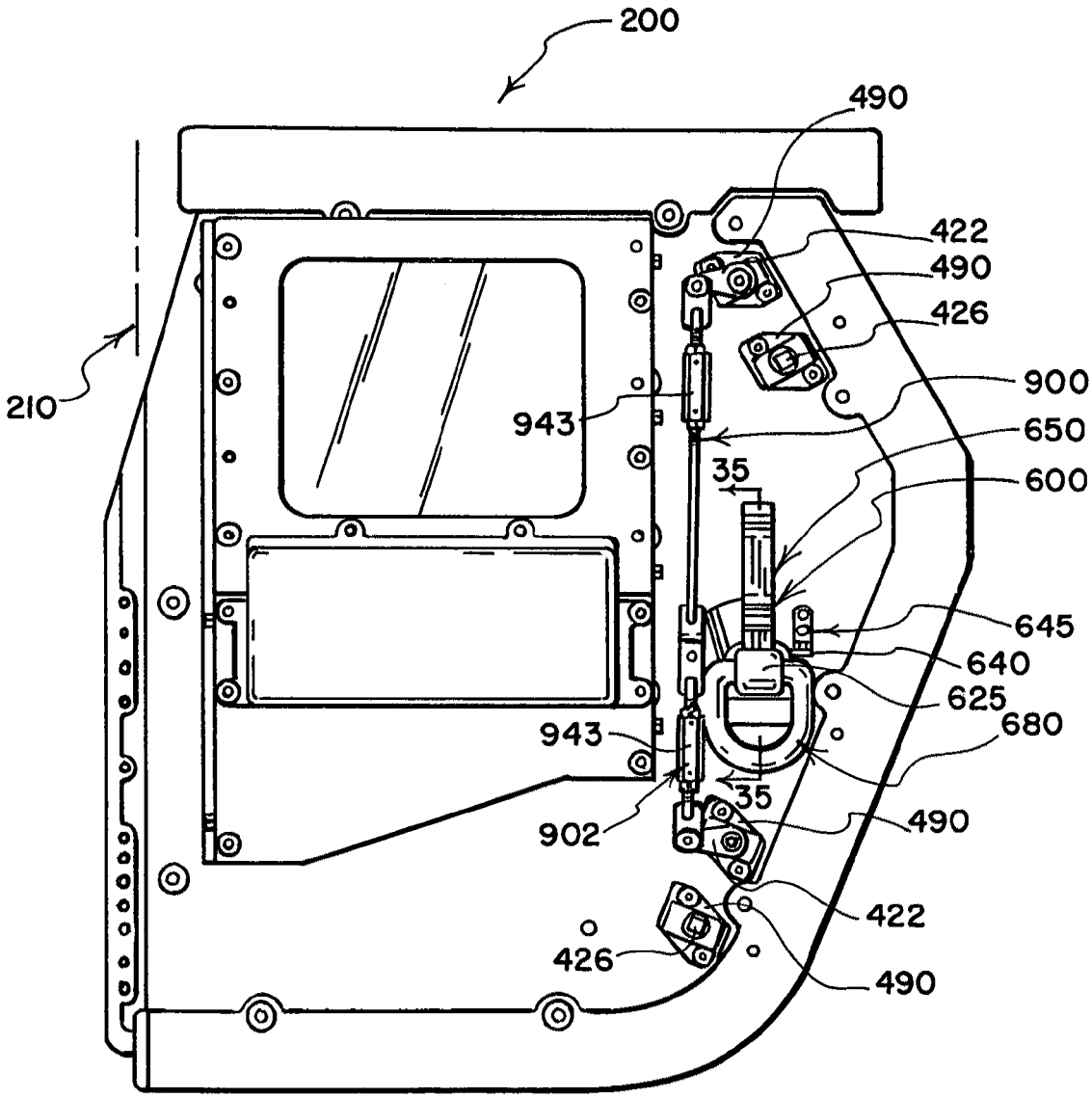
FIG. 3 is an exterior side view of selected portions of a left rear (driver's side) door of the vehicle, with the depicted exterior operating handle in its normal, non-operated position.
Figure 4:
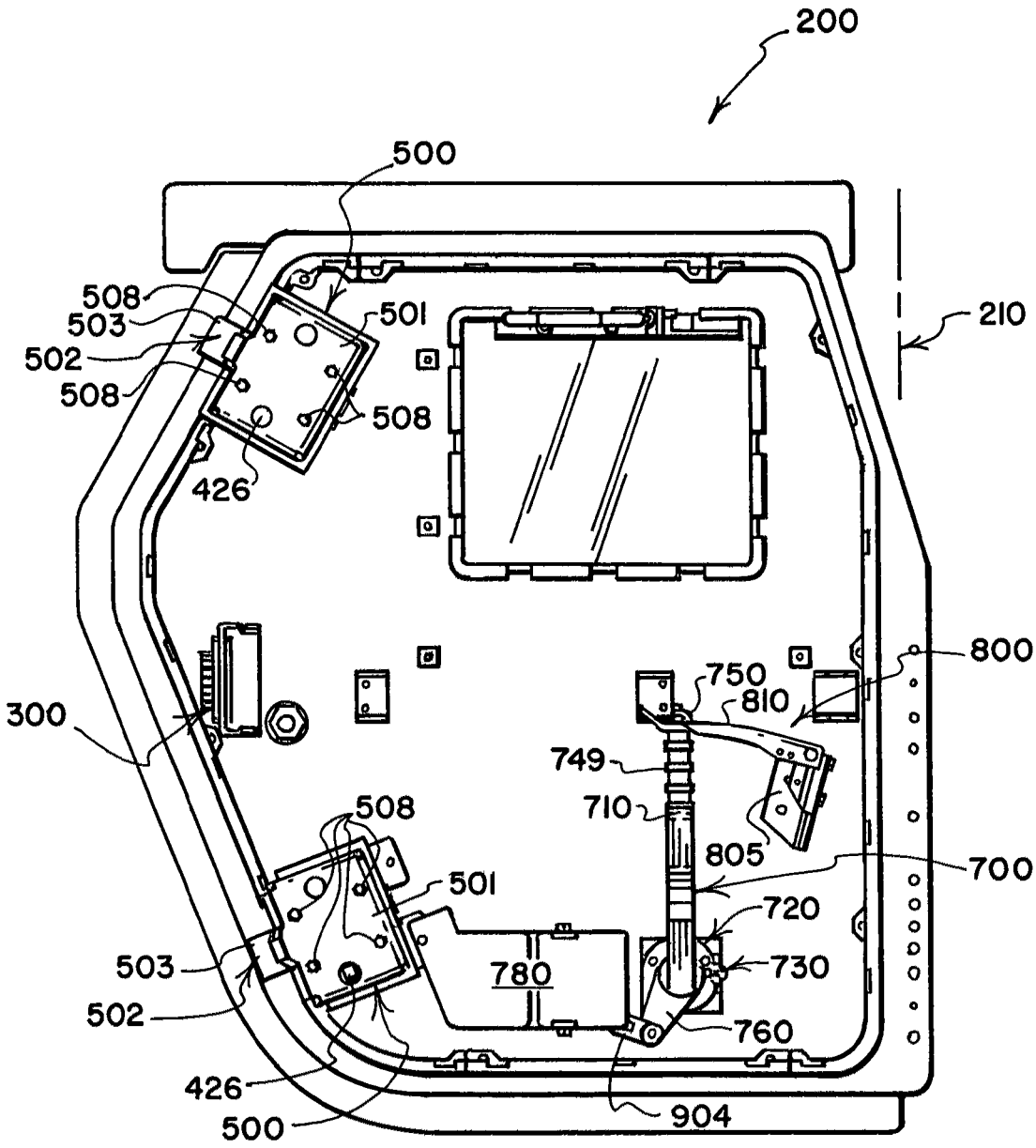
FIG. 4 is an interior side view thereof, with the depicted interior operating handle in its normal non-operated position.

Shown in FIGS. 3 and 4 are exterior and interior portions, respectively, of a left rear door 200 that may be used to close a left door opening at the rear of the vehicle's passenger compartment. A similarly configured door (not shown) having a configuration that substantially mirrors that of the left rear door 200 is provided to close a right door opening at the rear of the vehicle's passenger compartment.

The door 100 of FIGS. 1-2 and the door 200 of FIGS. 3-4 are heavy duty assemblies that each include a thick armor plate to shield occupants of the vehicle from the hostile environments through which the vehicle travels. Heavy duty hinges (not shown) are provided to mount the doors 100, 200 on an up-armored Humvee type vehicle so the doors 100, 200 can pivot about such axes as are indicated by the numeral 110 in FIGS. 1-2 and by the numeral 210 in FIGS. 3-4.

Referring to FIGS. 2 and 4, pairs of heavy duty latches (also referred to as "latch assemblies" or "latch mechanisms") 500 are provided on the interiors of the doors 100, 200 (and on similarly configured doors, not shown, that are provided on the opposite side of the vehicle, as has already been explained). Two of the heavy duty latches 500 are provided on each of the four doors of an Up-Armored Humvee to ensure that the doors of the vehicle will remain closed to safeguard occupants of the vehicle especially if the vehicle comes under attack.

Figure 41:
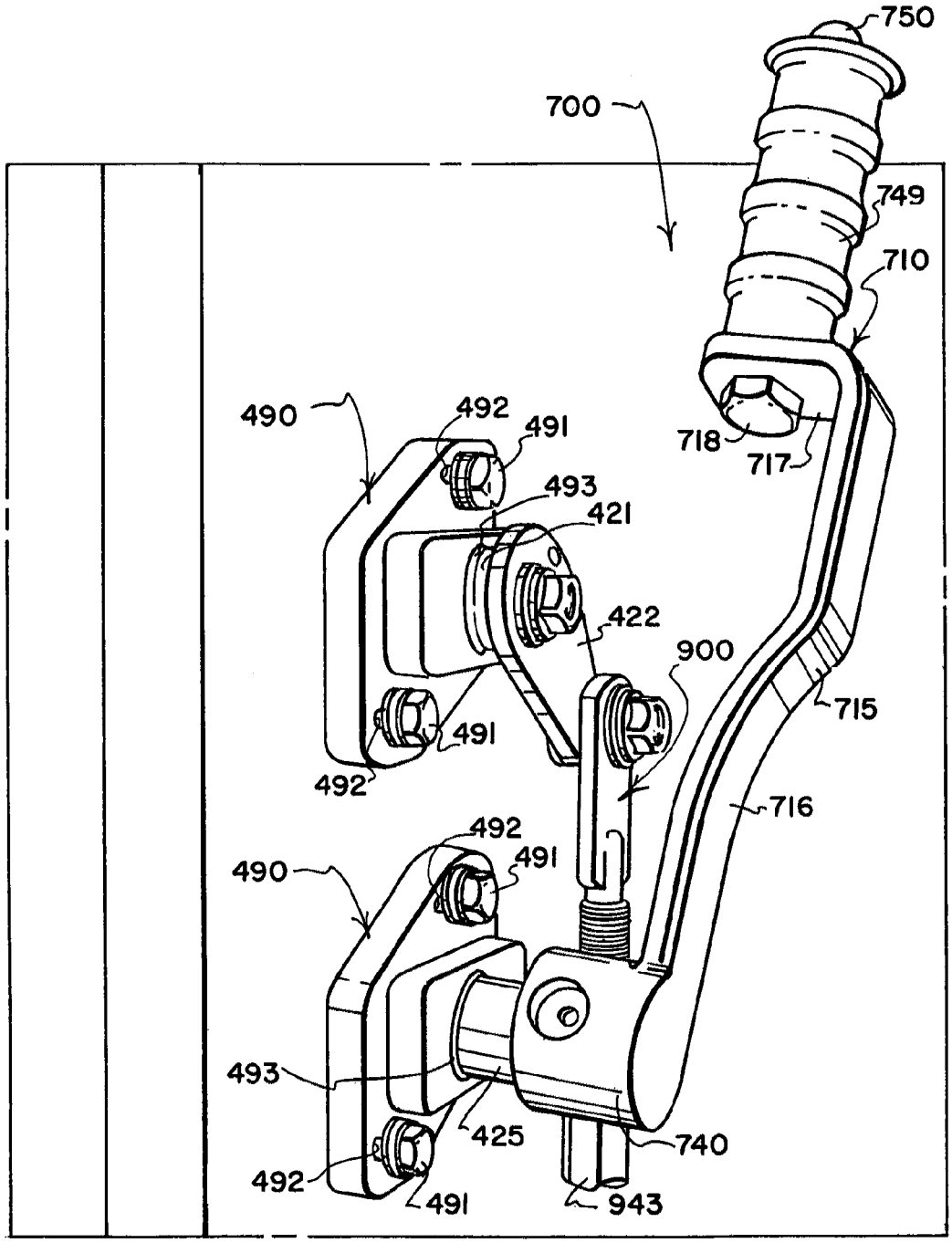
FIG. 41 is a perspective view showing the internal operating handle of FIG. 37 installed on an exterior connector to operate an associated one of the latch assemblies of FIGS. 5-14, and showing more completely than is depicted in FIGS. 1 and 3 two of the identical adjustable bearing blocks that journal exterior end regions of all of the relatively long shafts that are shown in FIGS. 7-14 connected to the latch assemblies.
Figure 42:
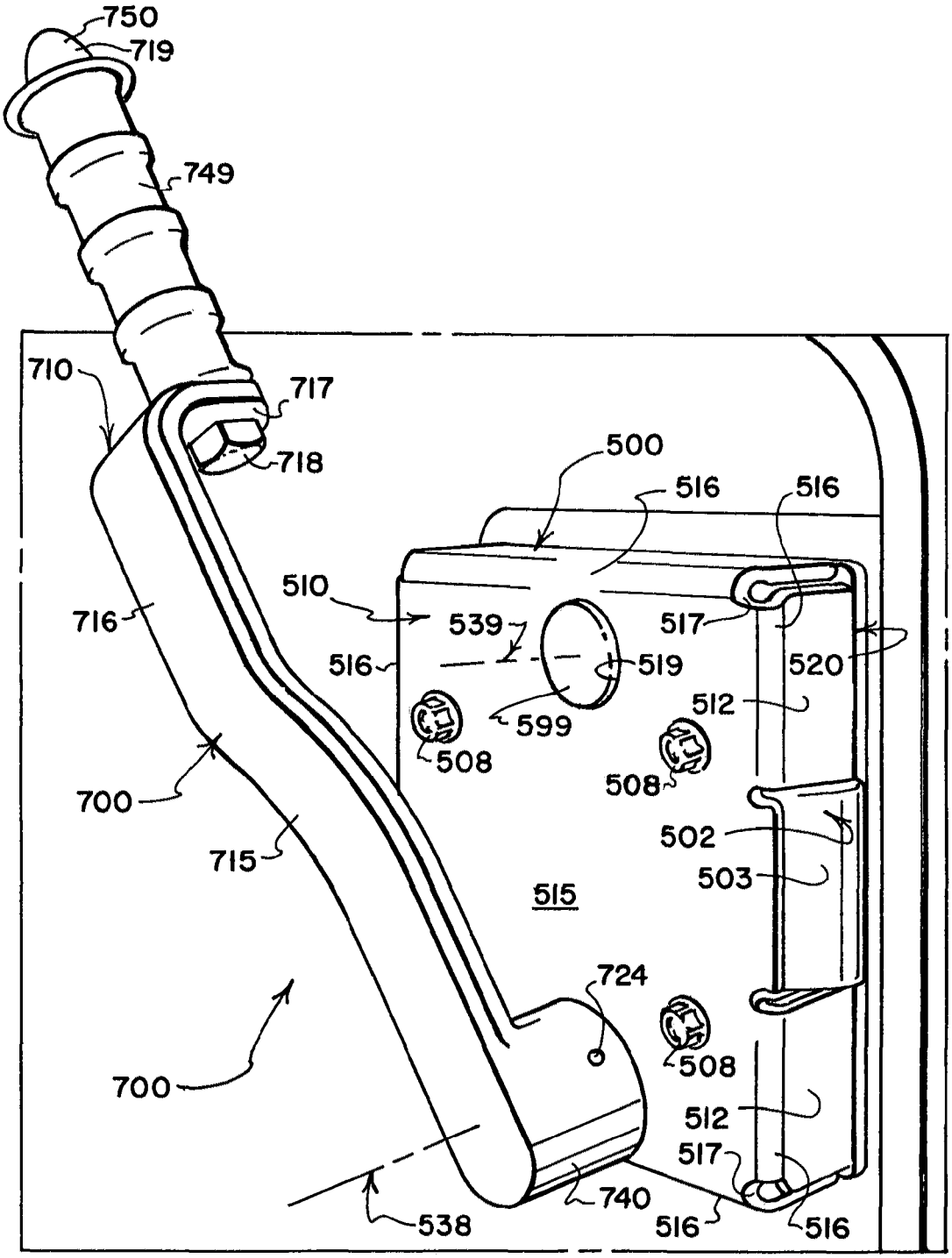
FIG. 42 is a perspective view showing the internal operating handle of FIG. 37 installed on an internal connector to operate an associated one of the latch assemblies of FIGS. 5-14, with the handle pivoted to an operated position causing the slide bolt of the depicted latch to retract.

Each of the latches 500 has a spring-projected slide bolt 502 (also referred to as a "latch bolt") that is positioned to engage a suitably configured strike or strike formation (not shown, but carried on or defined in a conventional way by vehicle structure that extends about the opening that is closed by the associated vehicle door). Each door of the vehicle is provided with handles that can be operated from inside and outside the vehicle doors to retract the latch bolts 502 so the vehicle doors can be opened. Exterior handles or handle assemblies 600 are shown in FIGS. 1, 3 and 34-36. Interior handles or handle assemblies 700 are shown in FIGS. 2, 4, 37, 43, 45 and 47 as the interior handles 700 are normally used inside an armored vehicle, and are shown in FIGS. 41 and 42 as the interior handles 700 can be used in emergency modes of operation, as will be explained.

Although all of the heavy duty latches 500 are formed from substantially identical sets of components (as is explained later herein in conjunction with FIG. 15 which shows a typical component set), some of the latches 500 are differently outfitted than others so the latches 500 can accommodate being mounted at door locations where the doors of an Up-Armored Humvee or other similar vehicle may differ in characteristics such as thickness, and to accommodate differences necessitated by the fact that some of the latches 500 are mounted on the left side of the vehicle as opposed to the right side, some on rear doors as opposed to front doors, and some on upper door portions as opposed to lower door portions. How the latches 500 are constructed, how they are outfitted to accommodate differences in door thickness, how they are operationally connected to other components carried on the doors of a vehicle, and how the latches 500 serve in normal and emergency modes to ensure that vehicle occupants can enter, leave, escape from or be rescued from inside the passenger compartment of an armored vehicle are explained later.

Figure 58:
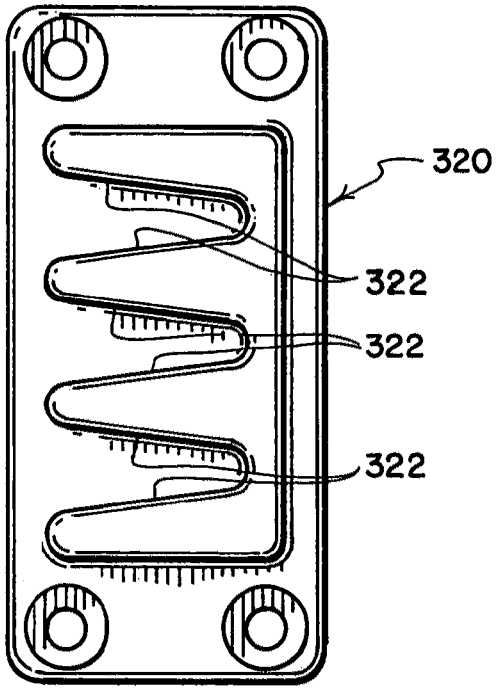
FIG. 58 is a front side view of one of two members of an alignment mechanism of the type provided internally of armored vehicle doors as depicted in FIGS. 2 and 4, showing three tapered recesses defined by spaced portions thereof.
Figure 59:
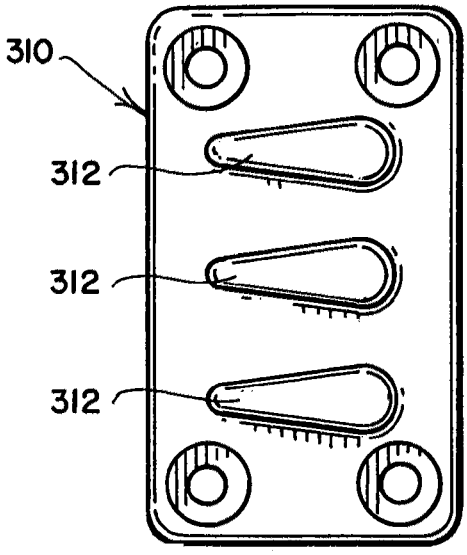
FIG. 59 is a front side view of the other of two members of the alignment mechanism, showing three projections of teardrop shaped cross-section configured to be received in the three tapered recesses of the member of FIG. 58.
Figure 60:
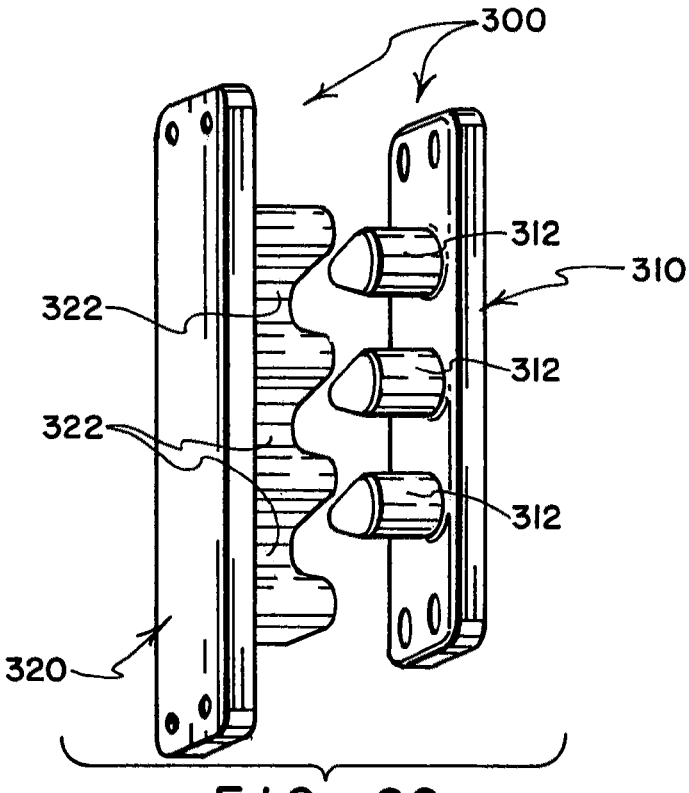
FIG. 60 is a perspective view showing the two alignment mechanism members of FIGS. 58-59 positioned to introduce the teardrop shaped projections into the recesses.
Figure 61:
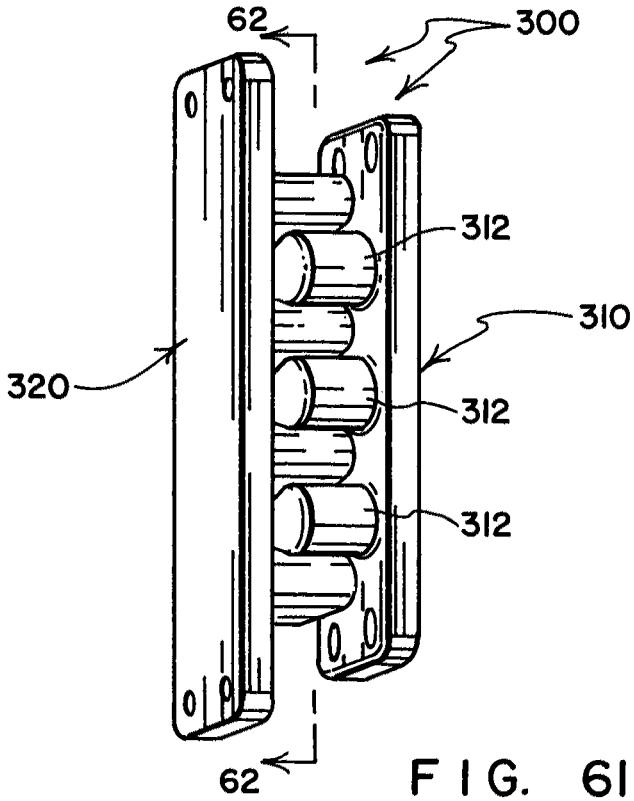
FIG. 61 is a perspective view similar to FIG. 60 but with the teardrop shaped formations wedgingly seated in the recesses; and, FIG. 62 is a sectional view as seen from a plane indicated by a line 62-62 in FIG. 61.

Referring still to FIGS. 2 and 4, door alignment mechanisms 300 are provided at locations between the pairs of latches 500 on each of the doors 100, 200 (and on other similarly configured doors, not shown, located on the opposite side of the vehicle, as has been explained). Referring to FIGS. 58-60, the alignment mechanisms 300 each include a door-carried component 310 mounted on the interior of the associated vehicle door, and a vehicle-carried component 320 mounted on a part of the vehicle which defines the door opening closed by the associated vehicle door. In the manner depicted in FIGS. 60-62, the alignment mechanism components 310, 320 engage as the doors 100, 200 are pivoted to their closed positions. The door-carried component 310 is provided with teardrop formations 312, and the vehicle-carried component 320 is provided with recess formations 322 configured to receive the teardrop shaped formations 312.

Figure 62:
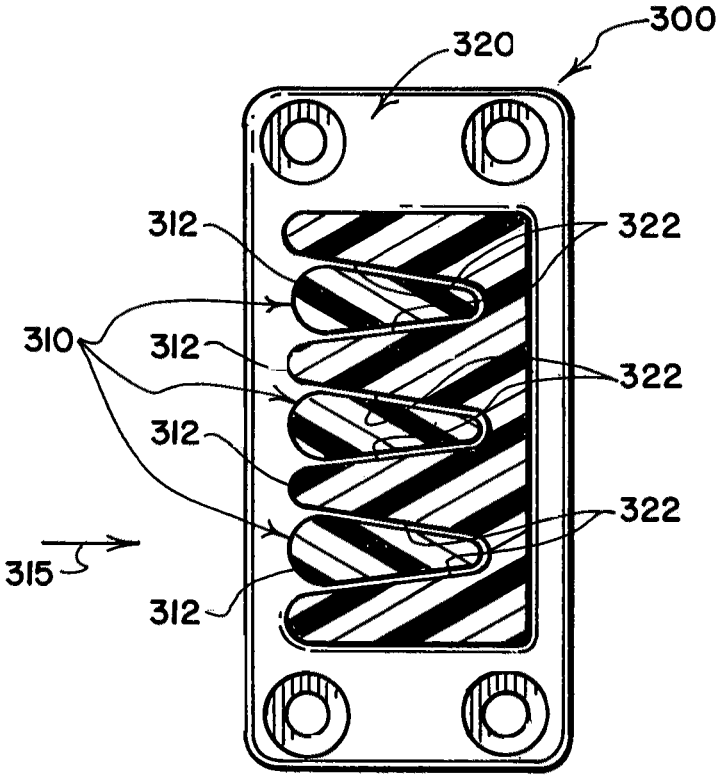

Referring to FIG. 62, as one of the doors of an armored vehicle closes, the door-carried component 310 is caused to move toward the vehicle-carried component 320 in a direction indicated by an arrow 315. Movement of the door-carried component 310 in the direction of the arrow 315 causes pointed forward end regions of the teardrop formations 312 to enter the spaces defined by the recess formations 322. The farther the teardrop formations 312 move into the recess formations 322, the better the teardrop formations 312 align with and eventually come to mate with the recess formations 322, which means that a wedging sort of action causes the door-carried component 310 (and the door on which it is carried) to align relatively precisely with the vehicle-carried component 320 so the door properly fills and closes the door opening, and so the latches 500 are caused to align their slide bolts 502 with associated strike openings (not shown). The interengagement of the formations 312, 322 as depicted in FIG. 62 cooperates while the vehicle doors are latched in closed positions to maintain proper alignment of the closed doors with their door openings so the spring-projected latch bolts 502 of the latch assemblies 500 attain and maintain properly latched engagements with their associated strikes or strike formations (which are carried on or defined in a conventional manner by structure of the vehicle extending about the door openings that are closed by the doors of the vehicle).

In preferred practice, each of the door alignment mechanism components 310, 320 is formed as single-piece steel casting. However, in lighter duty applications, the recess-defining formations 322 of the door carried components 320 and/or the teardrop shaped formations 312 of the door-carried components 310 may be formed from softer materials, perhaps even from relatively stiff resilient material such as plastic or rubber.

Figure 34:
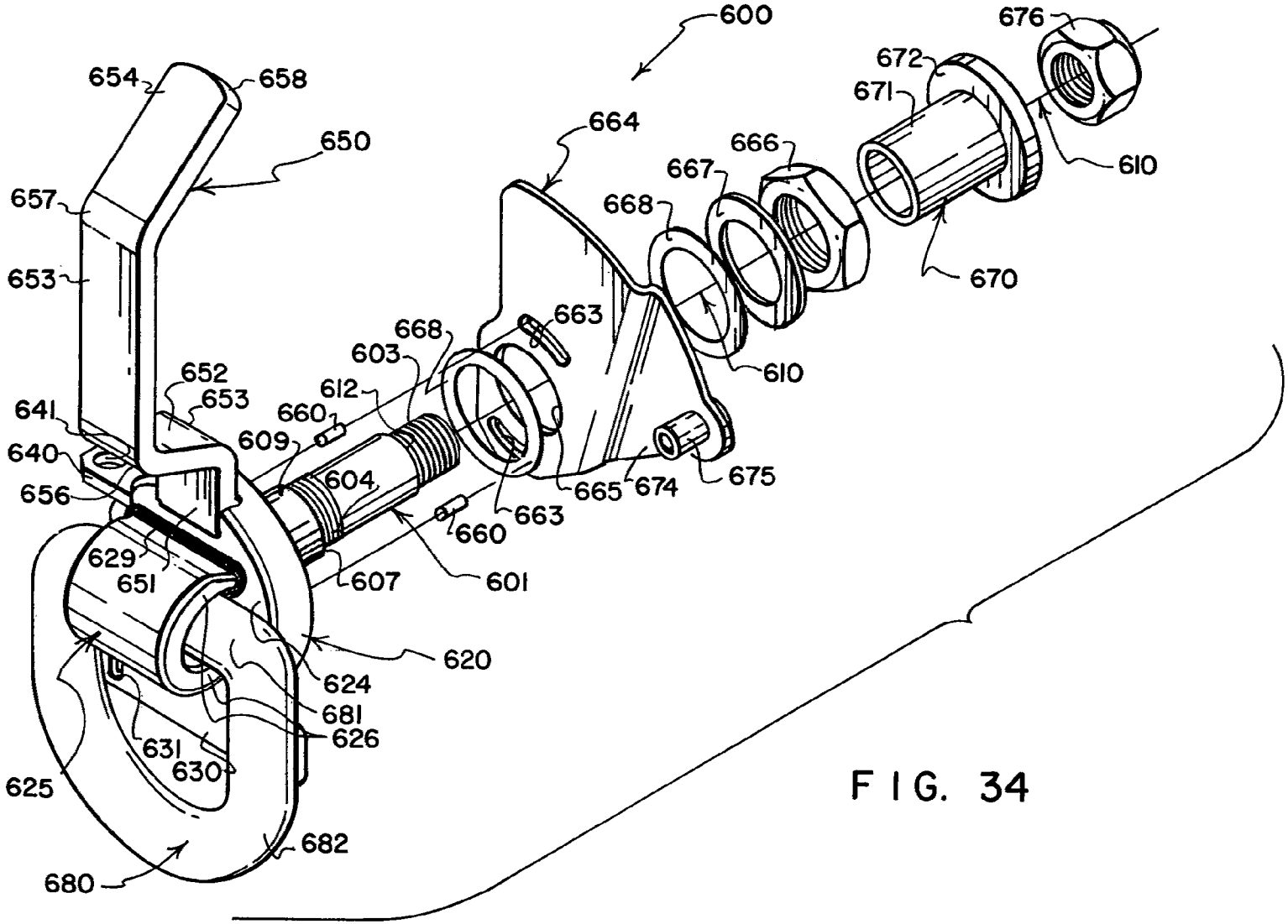
FIG. 34 is an exploded perspective view that shows a right side version of an exterior handle assembly which has an appearance that is a mirror image reversal of the left side exterior handle assemblies that are depicted in FIGS. 1 and 3, for operating an associated pair of the latch assemblies of the type shown in FIGS. 5-15.
Figure 35:
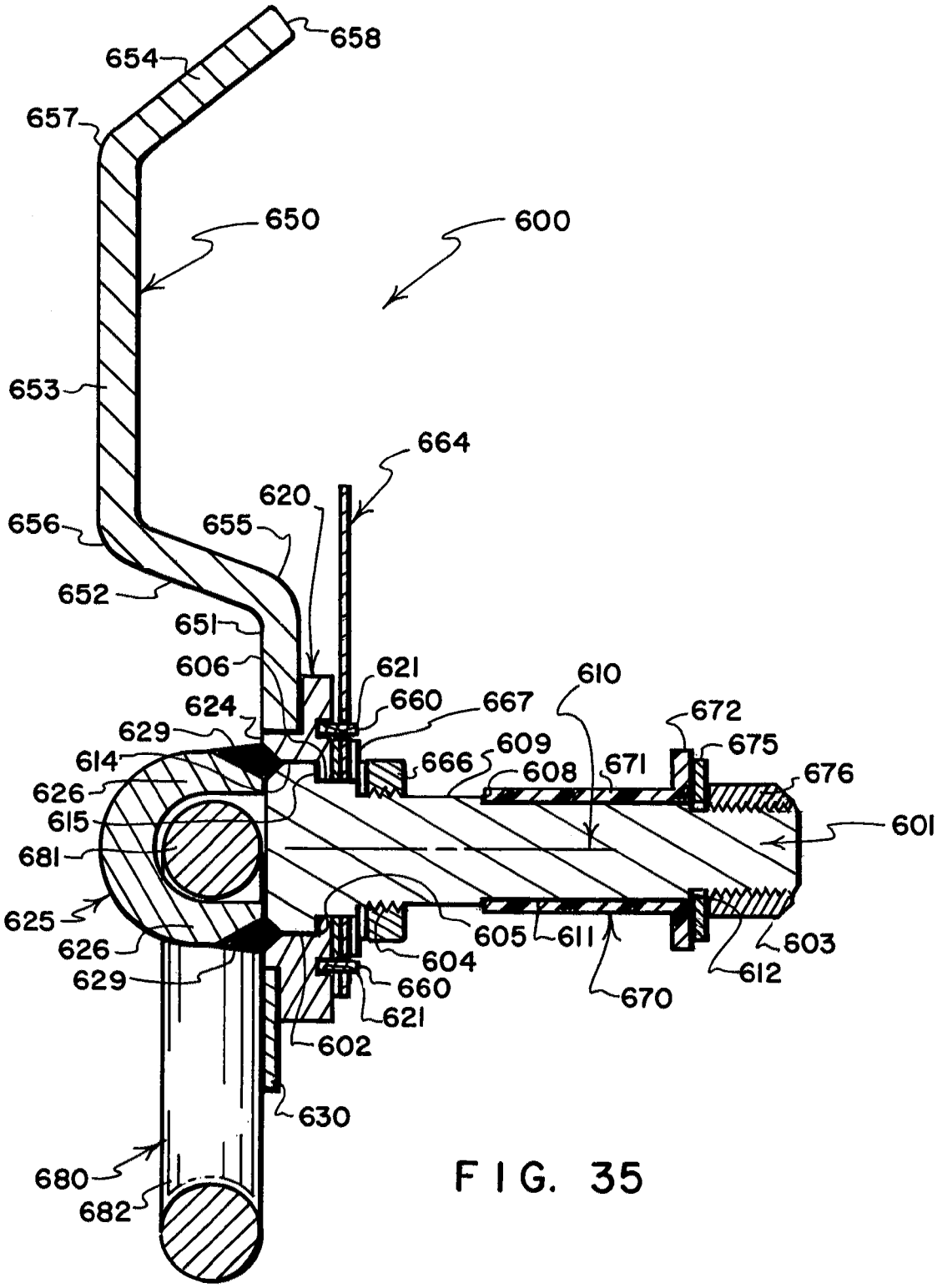
FIG. 35 is a cross-sectional view on an enlarged scale as seen from a plane indicated by a line 35-35 in either of FIGS. 1 and 3—a view that is equally applicable to right side exterior handles assembled from such components as are depicted in FIG. 34.
Figure 36:
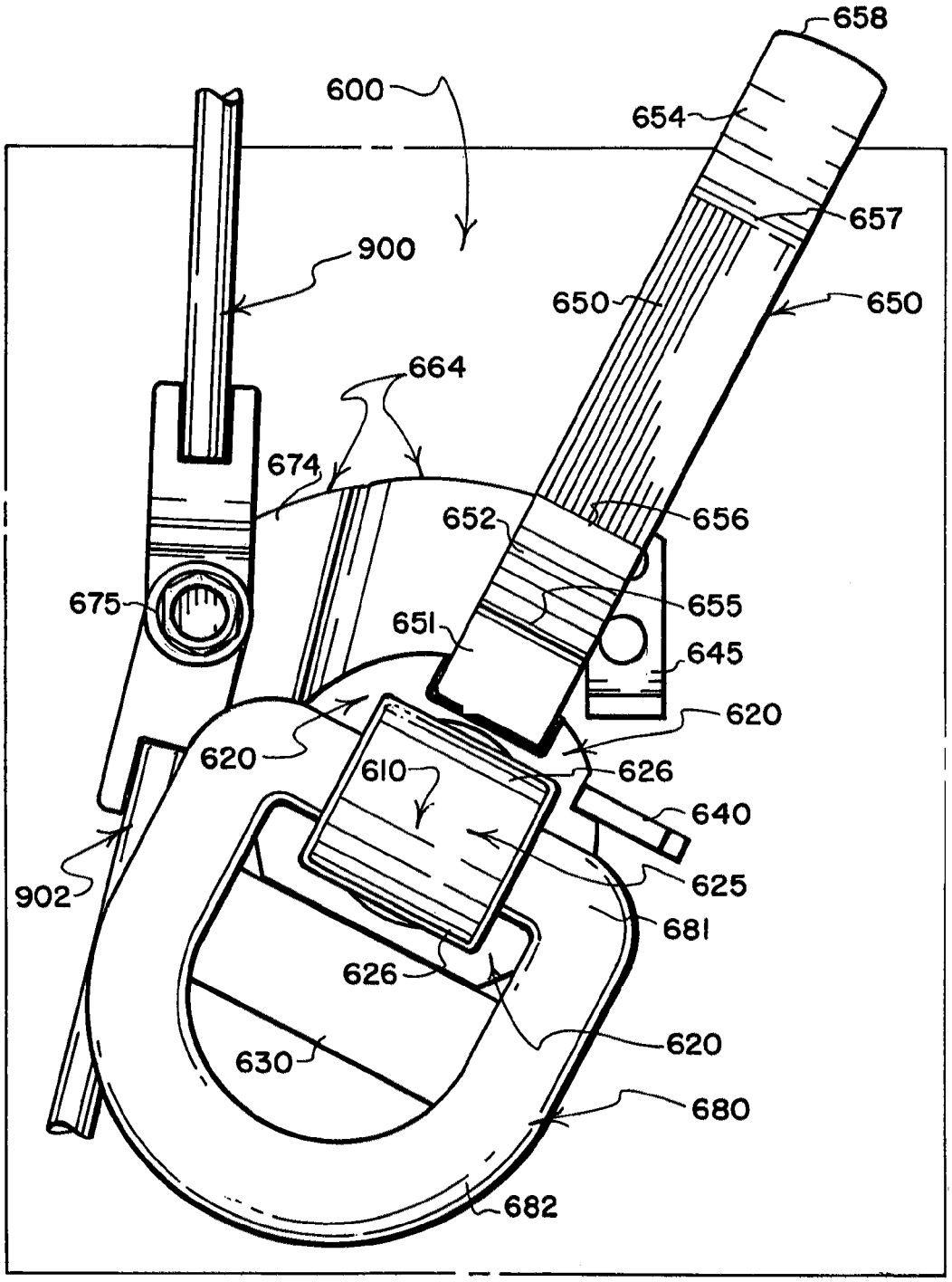
FIG. 36 is a side elevational view of one of the left side exterior handle assemblies shown in FIGS. 1 and 3, but with the handle turned to its operated position to move a pair of connecting rod links having end regions that overlap at a location where the links pivotally connect with a linkage plate of the handle assembly.

Referring to FIGS. 1, 3 and 34-36, the heavy duty handles 600 that are provided on the exteriors of each of the doors 100, 200 (and on similarly configured doors, not shown, but carried on the opposite side of the vehicle from the doors 100, 200) have grippable upstanding levers 650 that can be turned (for example, as depicted in FIG. 36) to move associated links and turn associated arms and shafts to operate an associated pair of the latch assemblies 500. When the handles 600 are turned, links 900, 902 (FIGS. 1, 3, 36, 55 and 57) that interconnect with the exterior handle assemblies 600 are caused to move and to turn a pair of arms 422 (FIGS. 1, 3 and 49) that connect with and cause the turning of shafts 420 (FIGS. 7-15) that operate the latches 500 in a normal mode of operation to substantially concurrently retract the slide bolts 502 of the associated latches 500 (as is explained in greater detail later herein). As will also be explained, the exterior handles 600 are so securely connected to the vehicle doors that D-ring components 680 of the handles 600 can be used as points of attachment for tow lines, winch lines and the like to enable other vehicles or other equipment (in an extreme emergency) to pull open one of the vehicle doors if the door in question cannot be opened quickly or conveniently using other normal and emergency techniques.

Referring briefly to FIGS. 7-14, it will be seen that the shafts 420, 425 depicted therein are of differing lengths. The depicted different lengths of the shafts 420, 425 accommodate different vehicle door thicknesses at locations where the latches 500 are mounted. What the shafts 425 provide (as will be explained in greater detail later herein) are emergency connectors (also referred to as "emergency connection points") 426 located outside the vehicle to which one of the internal handles 700 (FIGS. 2 and 4) can be attached for purposes of directly operating the latches 500 of a particular vehicle door on a one-at-a-time basis to open the door in an emergency mode of operation when the shafts 420 and other components more commonly used in normal modes of operation are inoperable or are not to be used to open the particular vehicle door.

To provide a way for the doors of the type shown in FIGS. 1-4 to be externally locked, an L-shaped bracket 645 (FIGS. 1, 3 and 36) is affixed to the exterior surface of each vehicle door at a location near where a disc-shaped base member 620 of one of the exterior handles 600 can be turned about a pivot axis 610 (see FIGS. 34-36), and a stop plate 640 (FIG. 36) is provided which extends from the base member 620 to just beneath a horizontally extending leg of the L-shaped bracket 645 where the stop plate 640 normally engages the bracket 645 when the handle 600 is in the non-operated position depicted in FIGS. 1 and 3. Aligned holes are formed through the horizontal leg of the L-shaped bracket 645 and through the stop plate 640 (see a typical one of these holes designated by the numeral 641 in FIG. 34). The shackle of a padlock (not shown) can be inserted through these aligned holes when the associated vehicle door is to be locked externally, and the presence of the padlock prevents the stop plate 640 from moving away from the bracket 645 as takes place when the exterior handle 600 is turned to an operating position as depicted in FIG. 36.

What follows in the next few paragraphs is an overview of how the external and internal operating handles 600, 700, interact, and how the slide bolts 502 of an associated pair of the latches 500 are caused to retract as the result of turning one or the other of the handles 600, 700. What also is about to be explained is how so-called "lost motion connections" associated with each of the external and internal operating handles 600, 700 permit each of the external and internal handles 600, 700 to turn to retract the slide bolts 502 of an associated pair of the latches 500 (without causing the other of the handles 600, 700 to turn when only one of the handles 600, 700 is being operated); and how the lost motion connection associated with the internal operating handle 700 permits the internal operating handle 700 to be "locked" to prevent the associated external operating handle 600 from being turned to retract the slide bolts 502 of an associated pair of the latches 500.

Referring to FIGS. 7, 9, 11, 13 and 15, it will be seen that the shafts 420 of the lower latch assemblies 500 carried on each vehicle door each connect with an arm 423 that carries a connector 424. Each of the arms 423 is located inside the armor plate (not shown) of an associated door, in a space that is provided between the inside surface of the armor plate and a cover 520 of the associated latch 500—which means that, when the latches of a particular door are viewed from inside the vehicle (for example as seen in FIGS. 2 and 4), the lower of the two latches on a particular door carries one of the arms 423 but at a location behind the latch 500 so the arm 423 is hidden from view by the latch 500. What is depicted in FIGS. 7, 9, 11, 13 and 15—and also in FIGS. 44 and 46—is the non-operated orientation of the arms 423. But, to operate each of the latches 500 shown in FIGS. 7, 9, 11, 13, 15, 44 and 46, the depicted arms 423 must be turned from the non-operated orientation shown in FIGS. 44 and 46 to an operated orientation such as is shown only in FIG. 48.

Figures 45, 46:
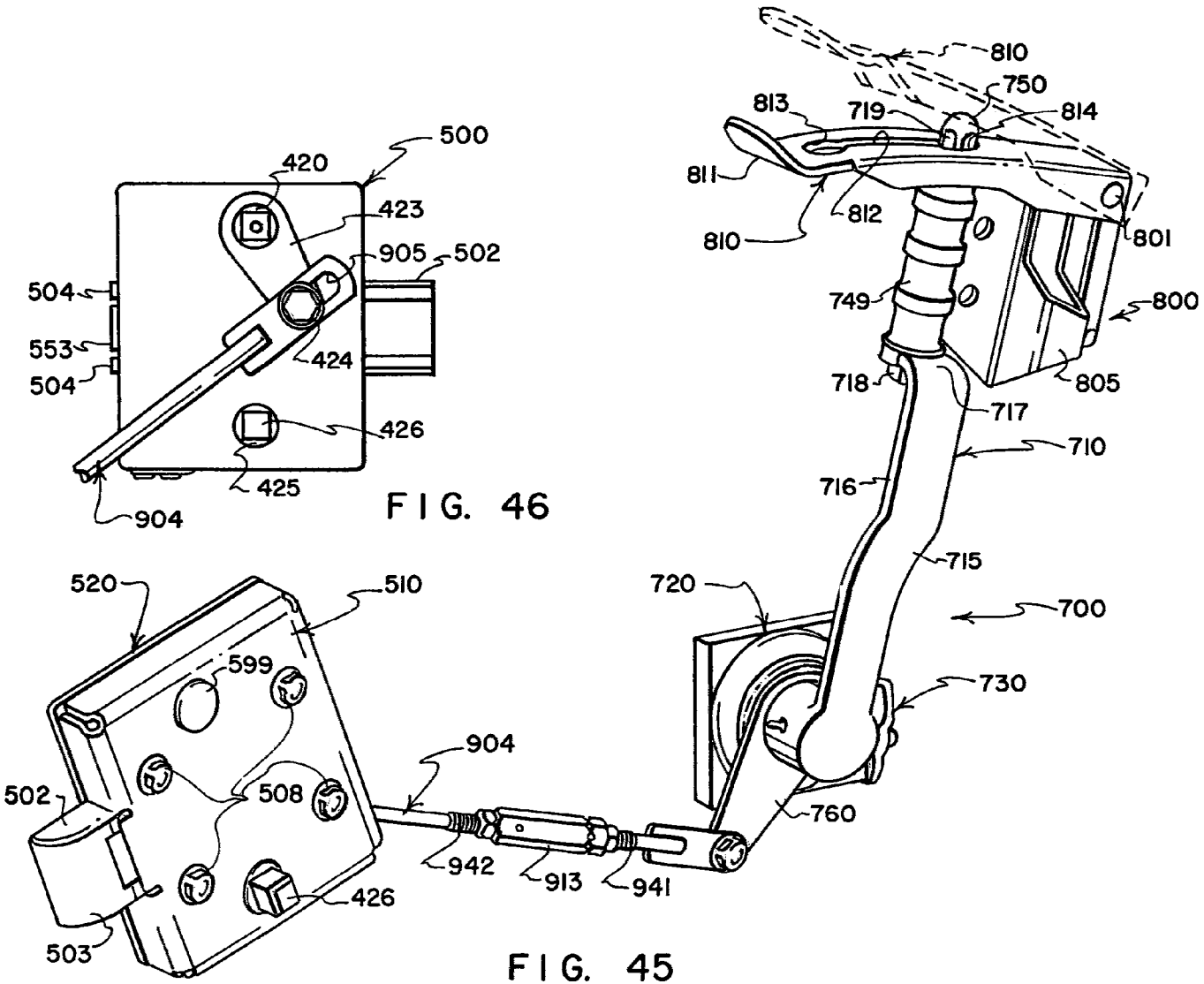
FIG. 45 is a perspective view showing the internal operating handle in its locked position and being retained therein by the same safety catch assembly shown in FIG. 43, with broken lines illustrating how the safety catch can be pivoted out of engagement with the upper end region of the internal operating handle.
FIG. 46 is a side elevational view showing the opposite side of the latch assembly depicted in FIG. 45, with the depicted position of a link that connects with the internal operating handle preventing an associated exterior operating handle from turning an arm of the depicted latch assembly to the operated position of the arm as shown in FIG. 48.

It is important at this point to understand that the associated latches 500 of each door (i.e., the latches 500 of FIGS. 7-8, 9-10, 11-12 and 13-14) are interconnected by various links 900, 902, 904 shown in FIGS. 55-57 and by other components that will be described, and that none of the latches 500 can have its slide bolt 502 retracted in a normal manner (i.e., by turning one of the external or internal operating handles 600, 700 depicted in FIGS. 1-4) unless and until an associated arm 423 depicted in FIGS. 7, 9, 11, 13, 15, 44 and 46 is turned from the non-operated orientation shown in FIGS. 44 and 46 to the operated orientation shown only in FIG. 48.

Only one of the two latches 500 carried on a particular door is provided an arm 423 that is turned to operate both of the door-carried latches 500 in a normal mode. The links 900, 902, 904 shown in FIGS. 55-57 and other components that will be described interconnect the two latches carried on a particular door so that, in a normal mode, the slide bolts 502 of the two latches 500 are caused to retract concurrently when the one arm 423 is turned to effect normal-mode operation of the two latches 500.

To provide a way for doors of the type shown in FIGS. 1-4 to be locked from inside the passenger compartment of the associated vehicle, the heavy duty interior handles 700 can be pivoted from their normal, non-operated positions depicted in FIGS. 2, 4 and 43, to a locked position shown in FIG. 45; and, when in the locked position, the interior handles 700 prevent the exterior handles 600 from being turned out of their normal, non-operated positions (shown in FIGS. 1 and 3) to operate the associated pair of latches 500. How the internal handles 700 prevent the external handles 600 from turning to operate the associated latches 500 has to do with a slot 905 shown in FIGS. 44, 46, 48 and 56 that is provided in one end region of an internal link 904 that connects the internal handle 700 to one of the arms 423—a slot 905 that receives one of the connectors 424 carried by one of the arms 423 sufficiently loosely to provide what is known to those skilled in the art as a "lost motion connection."

Figures 47, 48:
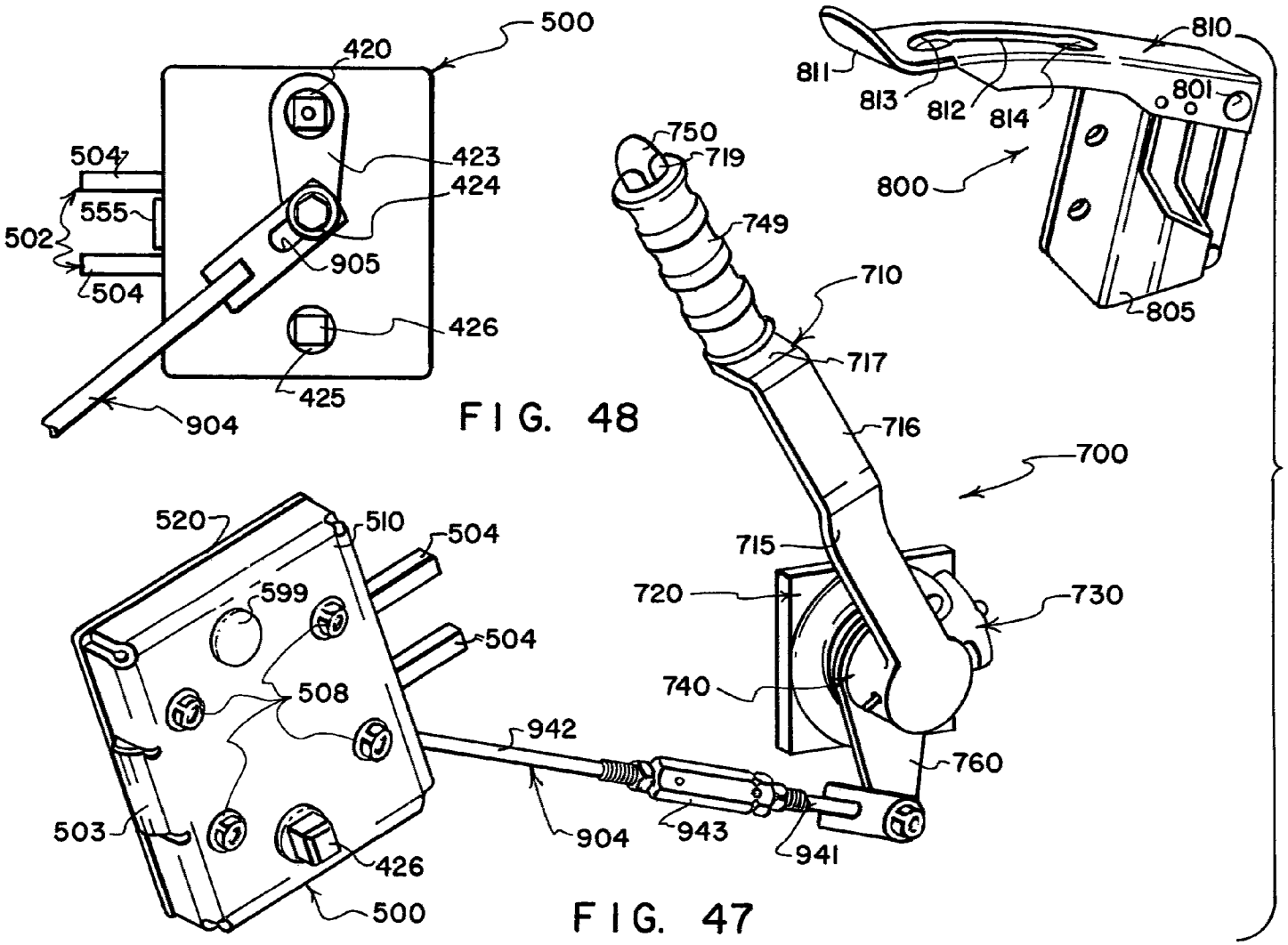
FIG. 47 is a perspective view showing the internal operating handle in its operated position.
FIG. 48 is a side elevational view showing the opposite side of the latch assembly depicted in FIG. 47, with the arm of the latch assembly shown turned to its operated position consistent with what is shown in FIG. 33 where a normal L-shaped tumbler arm is shown causing the slide bolt of the latch assembly of FIG. 33 to retract.

To unlatch (in a normal mode of operation) the typical latch 500 that is shown in FIGS. 44, 46 and 48, the arm 423 shown in these views must be turned from the non-operated orientation shown in FIGS. 44 and 46 to the operated orientation, such as is depicted only in FIG. 48. The arm 423 can be turned to the operated orientation of FIG. 48 in either of two ways: 1) by turning the internal handle 700 to cause the internal link 904 to move from the non-operated position of FIGS. 43-44 to the operated position of FIGS. 47-48 to thereby cause the arm 423 to pivot from the non-operated position of FIG. 44 to the operated position of FIG. 48, or 2) by turning the exterior handle 600 to move a link 902 to pivot an arm 422 that connects with the shaft 420 of the latch to, in turn, pivot the arm 423. However, the external handle 600 cannot turn the shaft 420 (as just described) to turn the arm 423 to the operated orientation of FIG. 48 unless the internal link 904 is in the non-operated position of FIG. 44—which is true because the connector 424 carried by the arm 423 extends into the slot 905 formed in one end region of the internal link 904 and engages an end region of the slot 905 which prevents the arm 423 from being turned to the operated orientation of FIG. 48 unless the internal link 904 is in the non-operated position of FIG. 44 where the slot 905 gives room to the connector 424 to let the arm 423 turn to the operated orientation shown in FIG. 48.

When the interior operating handle 700 is in the locked position of FIG. 45 causing the link 904 to be positioned as depicted in FIG. 46, an end of the slot 905 of the link 904 is engaged by the connector 424, and the arm 423 therefore cannot be turned to the operated orientation of FIG. 48 by the exterior handle 600—which means that the interior operating handle 700 disables the exterior operating handle 600 from unlatching the associated door when the interior operating handle 700 is "locked" as depicted in FIG. 45.

However, the links 900, 902, 904 and other components that connect a door-carried set of the exterior and internal handles 600, 700 (and other associated interconnection hardware) permit the internal handle 700 to be moved to its operated position (as typically shown in FIG. 47) even if the exterior handle 600 is padlocked, due to yet another "lost motion connection" that is provided by pins 660 that extend into curved slots 663 (as will be explained in conjunction with FIG. 34 which is discussed later herein); and this second lost motion connection permits occupants to exit the vehicle by turning the interior operating handle 700 to operate the associated latches even if the external handle 600 has been padlocked.

What the slot 905 and the connector 424 (FIGS. 44, 46, 48) provide is a lost motion connection that not only lets the internal operating handle 700 disable the external handle 600 when the internal operating handle 700 is in its locked position (FIG. 45), but also lets the external handle 600 unlatch the associated latches 500 when the internal handle 700 is in its non-operated position (FIG. 43). Thus, as will be understood, lost motion connections are provided at locations near each of the exterior and interior handles 600, 700 that permit one or the other of these handles to be turned to its operated position without causing the handle on the opposite side of the same door to move out of its normal, non-operated position.

Referring again to FIGS. 2 and 4, safety catch mechanisms 800 are provided on the interiors of each of the doors 100, 200 to retain the interior operating handles 700 in their non-operated positions (as typically shown in FIG. 43) and their locked positions (as typically shown in FIG. 45), and to limit the range of motion through which the internal handles 700 can be turned. As will be explained, the safety catch mechanisms 800 include pivotally mounted arms 810 that are biased toward positions of engagement with upper end regions 750 of the interior handles 700—arms 810 that, when in engagement with the upper end regions 750 of the interior handles 700, serve not only to prevent unintended movement of the interior handles 700 but also to retain the interior handles 700 in place when the handles 700 are in their locked or non-operated positions (depicted in FIGS. 45 and 43, respectively). As will also be explained, the arms 810 can be raised out of engagement with the upper end regions 750 of the internal operating handles 700 when it is desired to pivot the handles 700 to their operated positions (see the broken line depictions of the raised arms 810 in FIGS. 43 and 45)—an arrangement that helps to prevent unintended unlocking and unintended unlatching of the associated vehicle doors.

Many of the linkage components that drivingly connect the exterior handles 600 and their associated pairs of latches 500 are mounted on exterior sides of the doors 100, 200. Only a selected few linkage components are situated inside the armor of the doors 100, 200—an arrangement designed to shield vehicle occupants from the effects of explosions that might turn exterior-mounted components into deadly shrapnel injurious to occupants of the vehicle's passenger compartment if the exterior mounted components were, instead, mounted interiorly of the door armor. The link 904, the interior operating handle 700, and other components depicted in FIGS. 43-47 are situated inside the armor plate of the associated door on which these components may be mounted.

Included among the operational components that drivingly connect the latches 500 and the handles 600, 700 are bearing-supported shafts such as are indicated by the numerals 420, 425 in FIGS. 1, 3, and 7-14 that extend through the armor plate (not shown) of each of the doors of the vehicle to transfer torque force and rotational movement to and from the latches 500 and other components. Adjustably positionable bearing blocks 490 depicted in FIGS. 1, 3 and 41 which journal the exterior end regions of the shafts 420, 425 are situated outside the armor plate of the associated doors to ensure that the shafts 420, 425 extend properly along and turn smoothly about the pivot axes 538, 539 that are established by the latch assemblies 500.

These and other features and advantages will become apparent and be better understood from the other sections of the detailed description that follow.

The Latch Assemblies 500

As has been explained, on a military vehicle such as a so-called "Up-Armored Humvee," it is preferred that each of the four doors of the vehicle (i.e., each of the left front, the right front, the left rear and the right rear doors) carry at spaced locations a separate pair of the latches or latch assemblies 500, and that the latches or latch assemblies 500 of each pair cooperate to normally concurrently latch the associated door closed.

A typical left front door 100 of such a vehicle is shown in FIGS. 1 and 2, and can be seen in FIG. 2 to carry a pair of the latches 500, with one of the latches 500 (referred to as a "top latch") being mounted on the door 100 at a location higher than the other latch 500 (referred to as a "bottom latch"). Similarly, a typical left rear door 200 of such a vehicle is shown in FIGS. 3 and 4, and can be seen in FIG. 4 to carry a pair of the latches 500, with one of the latches 500 being mounted on the door 200 at a location higher than the other.

Although the drawings depict neither a right front nor a right rear door for such a vehicle, it will be understood that the right doors have appearances that are mirror images of the appearances of the corresponding left doors, and carry bottom and top latches having appearances that mirror the appearances of the corresponding bottom and top latches of the left doors.

The various bottom and top latches 500 that are mounted on the interiors of the left front, right front, left rear and right rear doors are of similar construction and operate similarly (but which are outfitted somewhat differently) are depicted in FIGS. 7-14 as having shafts 420, 425 of different lengths to accommodate different door thicknesses where the various latches 500 are installed. Although the outfitting of left door latches typically mirrors the outfitting of corresponding right door latches, the bottom and top latches of a particular door are differently outfitted because only the bottom latch 500 on any one of the doors of a vehicle needs to carry an arm 423 (FIGS. 7, 9, 11, 13 and 15) that connects with an internal linkage (as depicted in FIGS. 44, 46 and 48) so the latches 500 of the associated door can be operated in a normal mode by the exterior handle 600 and by the interior handle 700.

Figure 7:
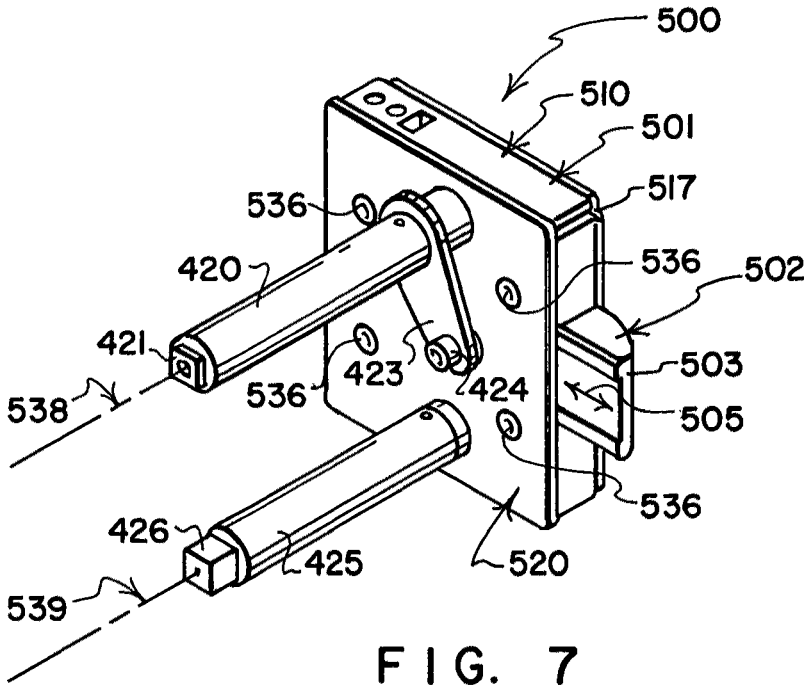
FIG. 7 is a perspective view showing a latch assembly outfitted for use on bottom portions of the left front door of FIGS. 1 and 2, with the slide bolt of the latch in its extended position.
Figure 8:
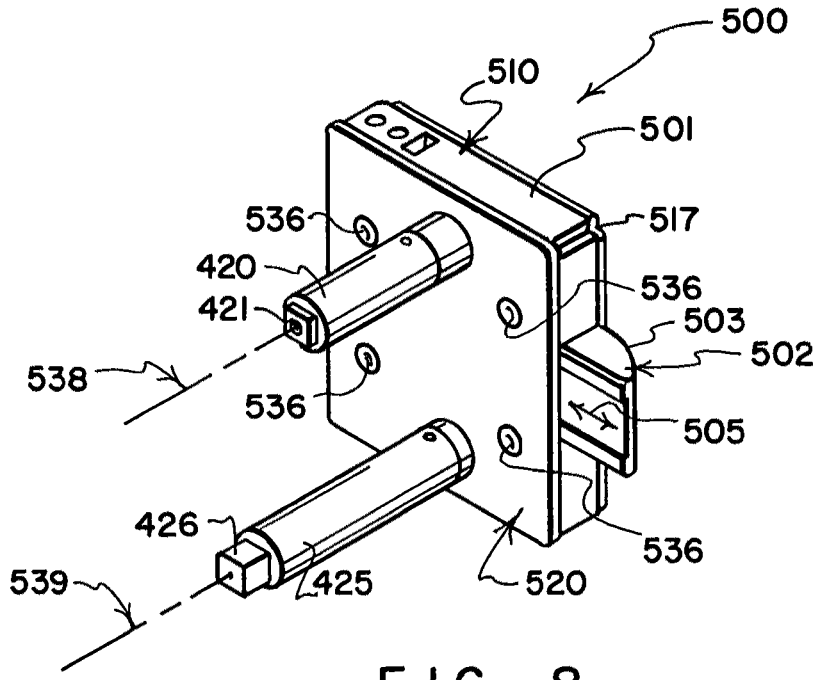
FIG. 8 is a perspective view showing a latch assembly outfitted for use on top portions of the left front door of FIGS. 1 and 2, with the slide bolt of the latch in its extended position.

The differing appearances of the eight latches 500 as outfitted for use on bottom and top regions of the left front, right front, left rear and right rear doors of an Up-Armored Humvee are illustrated in FIGS. 7-14. The latch 500 depicted in FIG. 7 is a front-left-bottom (FLB) form of the latch 500 that is used near the bottom of the left front door 100. The latch 500 depicted in FIG. 8 is a front-left-top (FLT) form of the latch 500 that is used near the top of the left front door 100.

Figure 9:
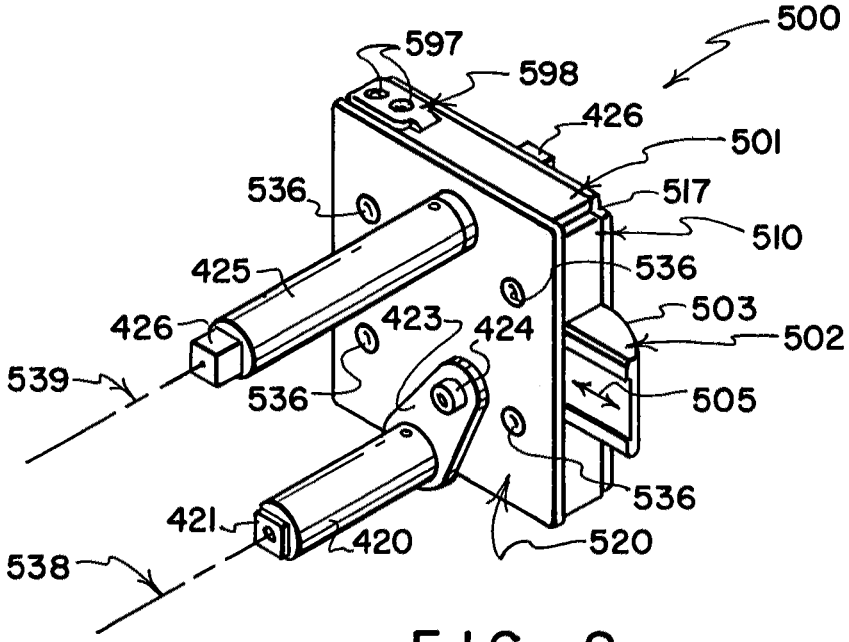
FIG. 9 is a perspective view showing a latch assembly outfitted for use on bottom portions of a right front door of the vehicle having an appearance that essentially mirrors the appearance of the door of FIGS. 1-2, with the slide bolt of the latch in its extended position.
Figure 10:
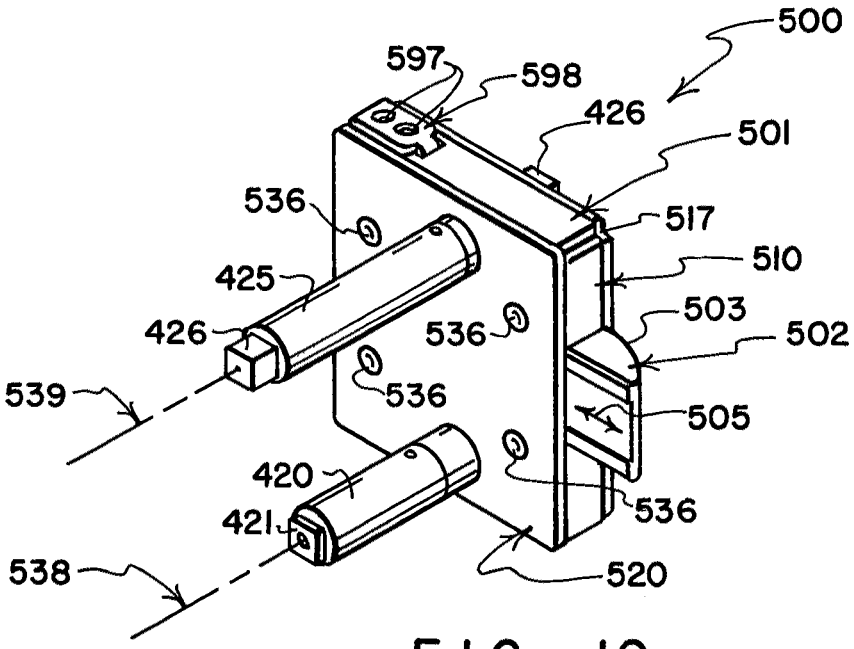
FIG. 10 is a perspective view showing a latch assembly outfitted for use on top portions of the right front door of the vehicle, with the slide bolt of the latch in its extended position.

The latch 500 depicted in FIG. 9 is a front-right-bottom (FRB) form of the latch 500 that is used near the bottom of the right front door. The latch 500 depicted in FIG. 10 is a front-right-top (FRT) form of the latch 500 that is used near the top of the right front door.

Figure 11:
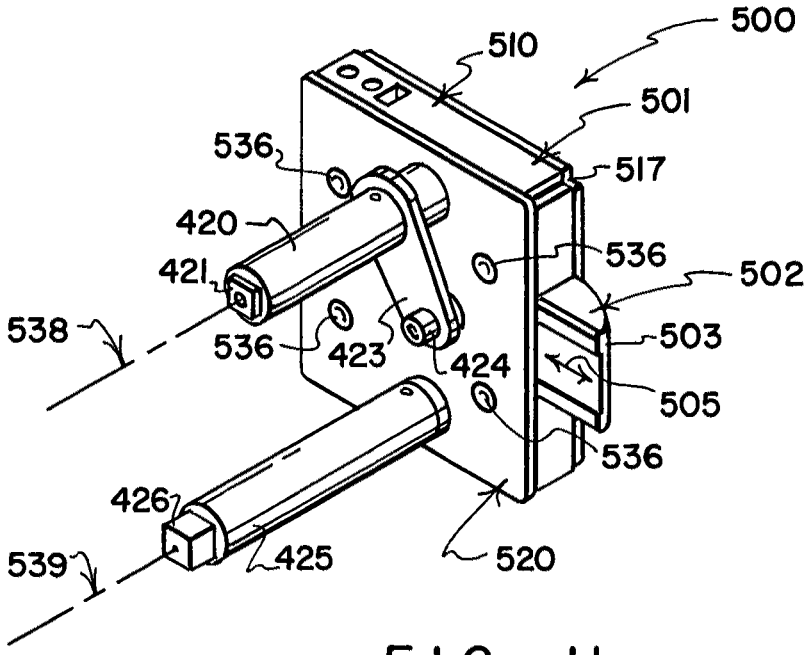
FIG. 11 is a perspective view showing a latch assembly outfitted for use on bottom portions of the left rear door of FIGS. 3-4, with the slide bolt of the latch in its extended position.
Figure 12:
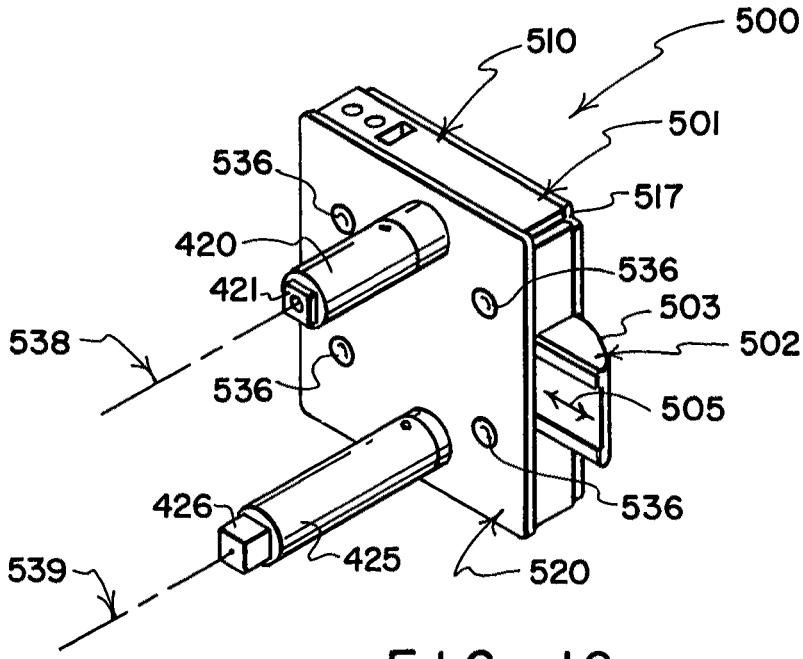
FIG. 12 is a perspective view showing a latch assembly outfitted for use on top portions of the left rear door of FIGS. 3-4, with the slide bolt of the latch in its extended position.

The latch 500 depicted in FIG. 11 is a rear-left-bottom (RLB) form of the latch 500 that is used near the bottom of the left rear door 100. The latch 500 depicted in FIG. 12 is a rear-left-top (RLT) form of the latch 500 that is used near the top of the left rear door 100.

Figure 13:
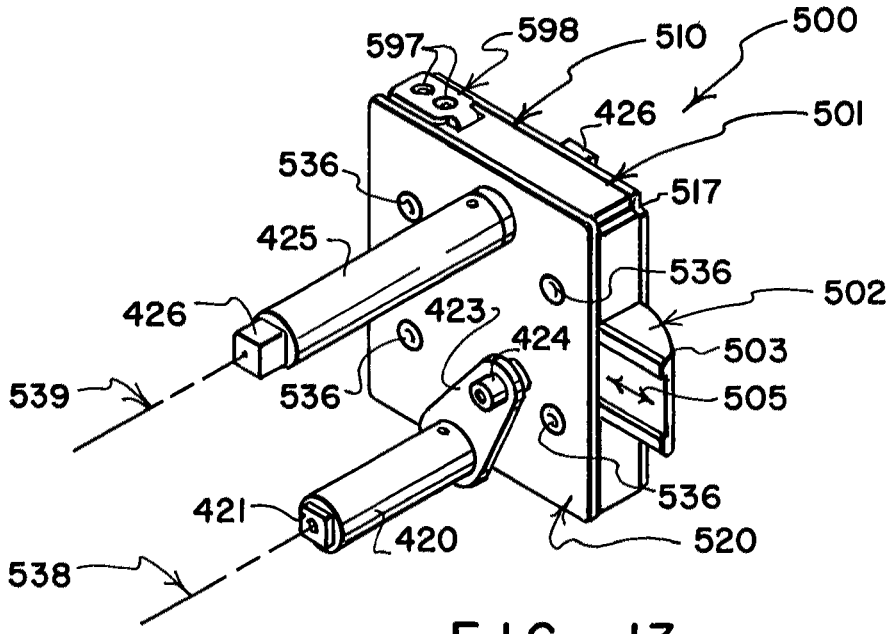
FIG. 13 is a perspective view showing a latch assembly outfitted for use on bottom portions of a right rear door of the vehicle having an appearance that essentially mirrors the appearance of the door of FIGS. 3-4, with the slide bolt of the latch in its extended position.
Figure 14:
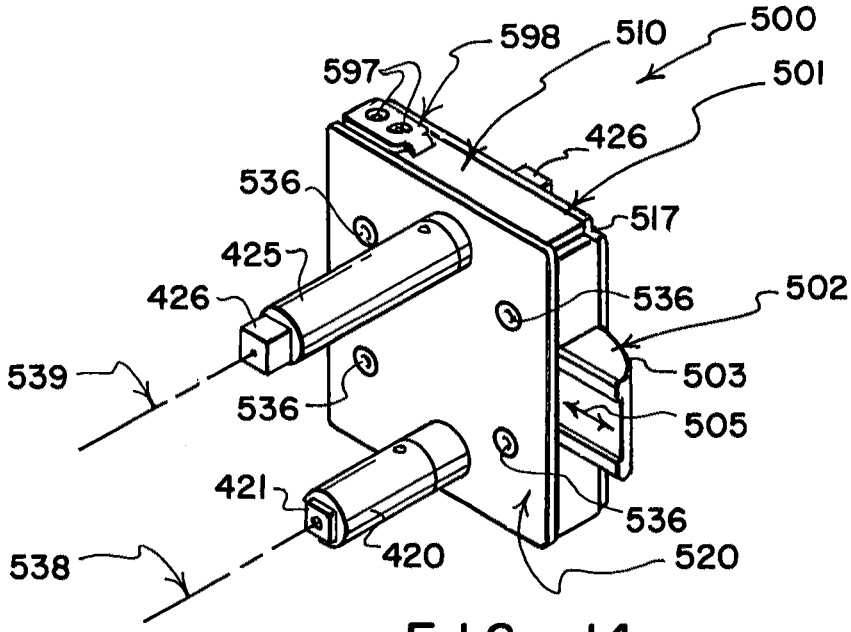
FIG. 14 is a perspective view showing a latch assembly outfitted for use on upper portions of the right rear door of the vehicle, with the slide bolt of the latch in its extended position.

The latch 500 depicted in FIG. 13 is a rear-right-bottom (RRB) form of the latch 500 that is used near the bottom of the right rear door. The latch 500 depicted in FIG. 14 is a rear-right-top (RRT) form of the latch 500 that is used near the top of the right rear door.

Each of the latch assemblies 500 that are shown in FIGS. 7-14 can be operated both in a normal mode, and in an emergency mode. Stated in another way, each of the latch assemblies includes components that normally are used to retract the associated latch bolt 502, and each includes components that can be used in an emergency to retract the associated latch bolt 502.

For purposes of normal mode operation, each of eight versions of the latch assembly 500 that are depicted in FIGS. 7-14 will be seen to be provided with a normal operating shaft 420 (the lengths of which vary in accordance with the thicknesses of the vehicle doors at locations where the latches 500 are installed). Each of the normal operating shafts 420 of the bottom latches 500 shown in FIGS. 7, 9, 11 and 13 carry one of the arms 423 at a location inside the armor plate of the door on which these latches are installed (at a location between the armor plate and the housing of the associated latch 500).

Each of the shafts 420 of all of the latches 500 shown in FIGS. 7-14 (as well as all of the shafts 425) projects from the exterior side of its associated latch assembly 500 along a normal pivot axis 538, and each of the normal operating shafts 420 is intended to pivot about its associated axis 538. External end regions of each of the shafts 420, 425 are journaled by adjustable bearing block assemblies 490 (discussed later in conjunction with FIG. 41).

Provided at each of the outer ends of each of the normal operating shafts 420 is an identical, relatively small, square male drive formation 421 that is designed to be received in a square hole (not shown) of equal size formed through a pivot arm of the type labeled by the numerals 422 in FIGS. 1, 3, 49 and 50. The drive connection established by the extension of the square drive formations 421 into mating female drive formations 427 (FIG. 49) of the arms 422 assures that the arms 422 pivot about their associated pivot axis 538 in unison with the shafts 420 to which the arms 422 are connected.

Figure 49:
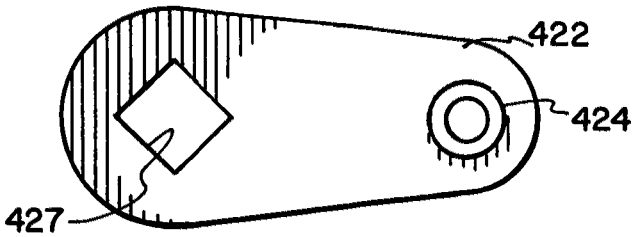
FIG. 49 is a side elevational view of one of the operating arms to which shafts from the latches shown in FIGS. 7-14 connect.
Figure 50:
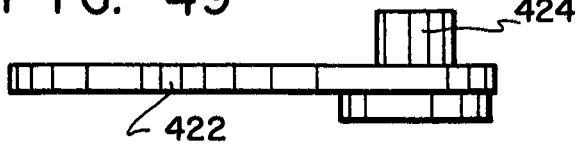
FIG. 50 is an end elevational view thereof.
Figure 51:
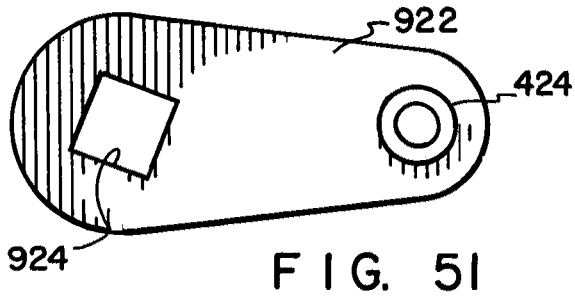
FIG. 51 is a side elevational view of another of the operating arms to which shafts from the latches shown in FIGS. 7-14 may connect.
Figure 52:
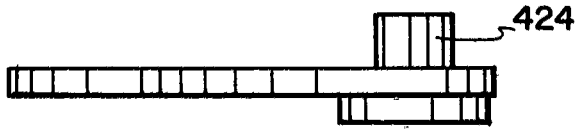
FIG. 52 is an end elevational view thereof.
Figure 53:
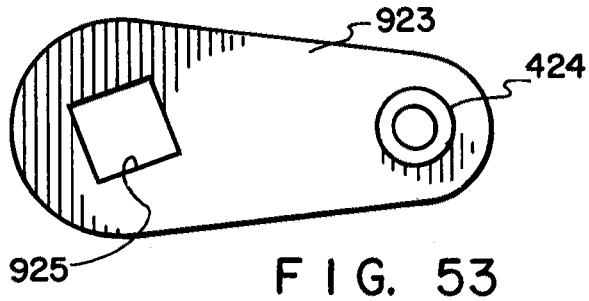
FIG. 53 is a side elevational view of another of the operating arms to which shafts from the latches shown in FIGS. 7-14 may connect.
Figure 54:
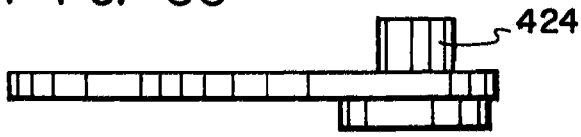
FIG. 54 is an end elevational view thereof.

In some instances, the arm 422 as depicted in FIG. 49 may need its square hole 427 oriented slightly differently to accommodate a particular installation; and, to this end, a first alternative arm 922 shown in FIGS. 51 and 52, and a second alternative arm 923 shown in FIGS. 53 and 54 are provided that have square holes 924, 925 which are oriented a bit differently than the square hole 427 that is provided in the arm 422.

For purposes of emergency mode operation, each of eight versions of the latch assembly 500 that are depicted in FIGS. 7-14 will be seen to be provided with an emergency operating shaft 425 (the lengths of which vary in accordance with the thicknesses of the vehicle doors at locations where the latches 500 are installed). Each of the emergency operating shafts 425 projects from an exterior side of its associated latch assembly 500 along an emergency pivot axis 539, and each of the emergency operating shafts 425 is intended to pivot about its associated axis 539.

Provided at outer ends of each of the emergency operating shafts 425 is an identical, relatively large, square male connector or connection formation or connection point 426 that is designed to be received in a close fit within a specially designed recess 741 (see FIG. 37) of a hub 740 of the interior operating handle 700 at a time after the interior operating handle 700 has been removed from its normal interior mount 720 (see FIGS. 37 and 38) and attached, instead, to one of the connection formations 426 located exteriorly of one of the vehicle doors (see FIG. 41) where outer end regions of the shafts 420, 425 are journaled by adjustably positionable bearing block assemblies 490 which are depicted in FIGS. 1 and 3, and in greater detail in FIG. 41.

Referring to FIG. 41, the bearing block assemblies 490 are preferably formed as castings that carry internal bushings 493. Each of the bearing block assemblies 490 journals an exterior end region of one of the shafts 420, 425 (depicted in FIGS. 7-14), and each is held in place by a pair of cap screws 491 that extend through slots 492 defined by the bearing block assemblies 490. The slots 492 permit the locations at which the bearing block assemblies 490 are mounted on the vehicle doors to be adjusted as may be needed to attain and maintain smooth turning movement of the shafts 420 that normally operate the latches 500, and the shafts 425 that are available to operate the latches 500 in emergencies, as will be explained shortly. Shims (not shown) also may be used to assist in properly positioning the bearing block assemblies 490 so the shafts 420, 425 turn freely about the axes 538, 539.

Figure 5:
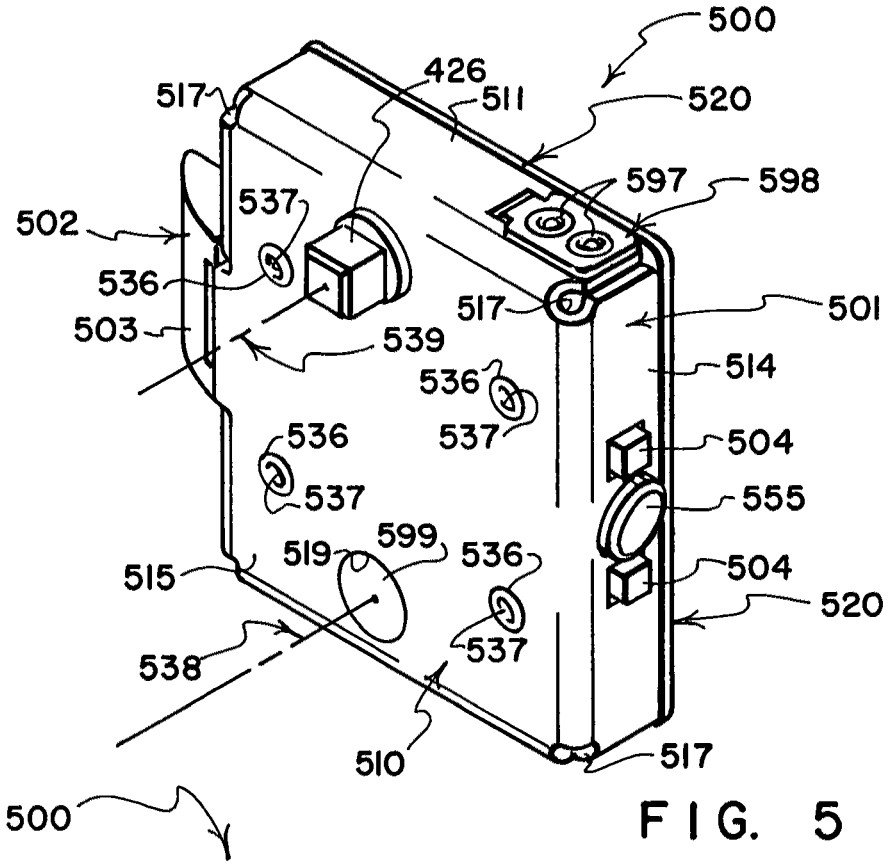
FIG. 5 is a perspective view showing one of two interior configurations of the latch assemblies used to hold the doors of an armored vehicle in closed position, with the slide bolt of the latch in its extended position.
Figure 6:
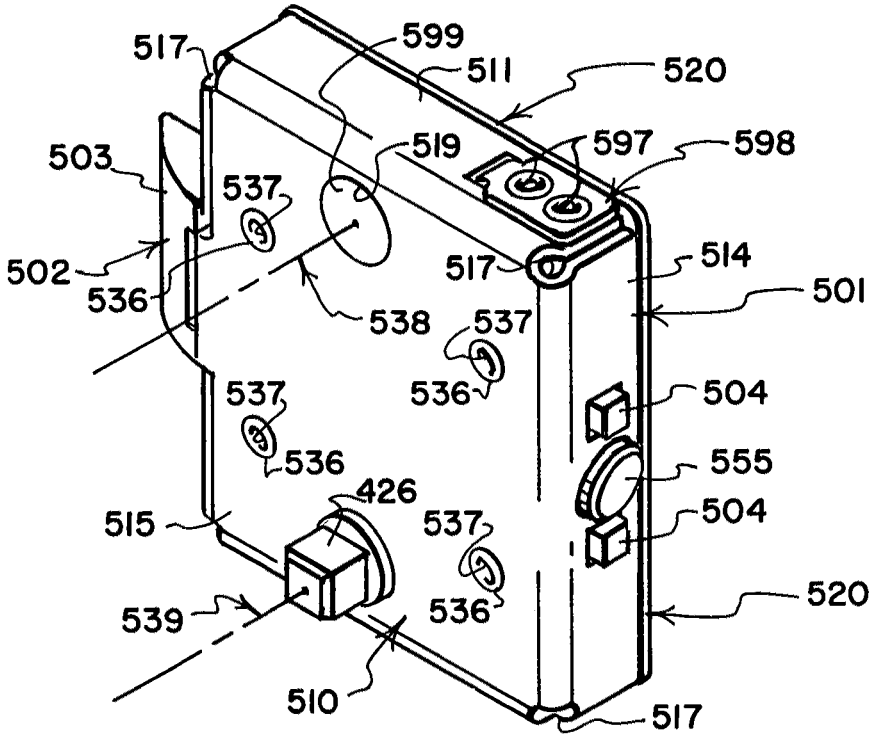
FIG. 6 is a perspective view showing the other of two interior latch configurations used to hold closed the doors of an armored vehicle, with the slide bolt of the latch in its extended position.

Just as the pivot axes 538, 539 can be seen in FIGS. 7-14 to project from the depicted exterior sides of the latch assemblies assemblies 500, so, too, the pivot axes also project from interior sides of the latch assemblies, as can be seen in FIGS. 5 and 6 (which show interior appearances offered by the latch assemblies 500 that have the exterior appearances depicted in FIGS. 7-14). Where the normal pivot axis 538 projects from an interior side of the casing 501 of each of the latch assemblies 500, a smooth blank surface 599 will be seen to close a hole 519 formed through the housing 510. But, where the emergency pivot axis 539 projects from an interior side of the casing 501 of each of the latch assemblies 500, one of the relatively large, square male connection points 426 (which is identical to the connection point 426 provided on the outer end regions of the shafts 425 as depicted in FIGS. 7-15) will be seen to be provided.

If need be (for example in an emergency situation when normal operating components of the latches 500 are not operable or are not to be used to open a selected armored vehicle door) the hub 740 of the internal handle 710 can be installed on any of the connection points 426. In FIG. 41, one of the interior operating handles 710 is shown installed on an external connector 426 and turned to operate an associated one of the latches 500 (not shown); and, in FIG. 42, one of the interior operating handles 710 is shown installed on an internal connection point 426 and turned to retract the slide bolt 502 of an associated one of the latches 500.

Figure 15:
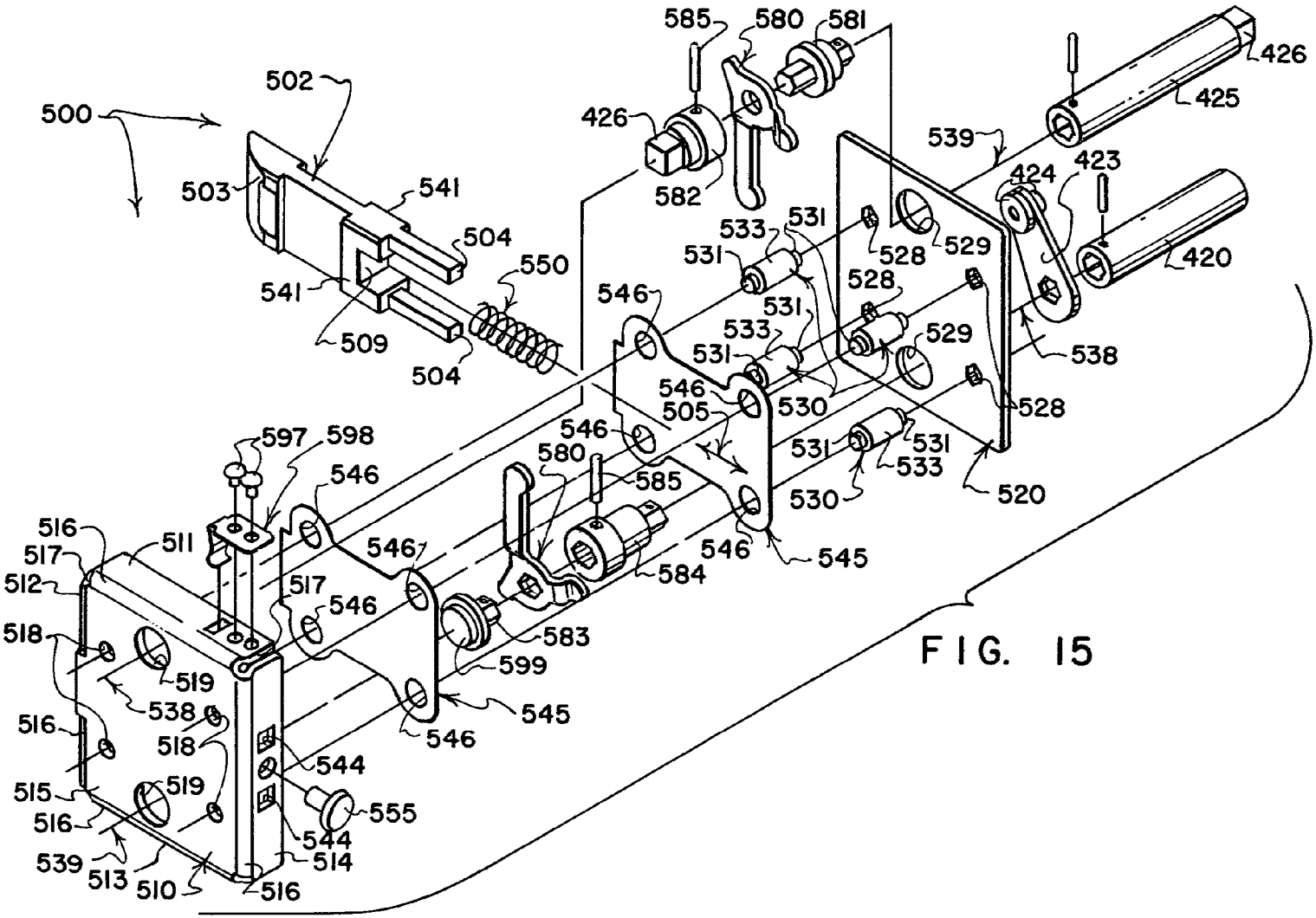
FIG. 15 is an exploded perspective view of the latch assembly of FIG. 9.
Figure 17:
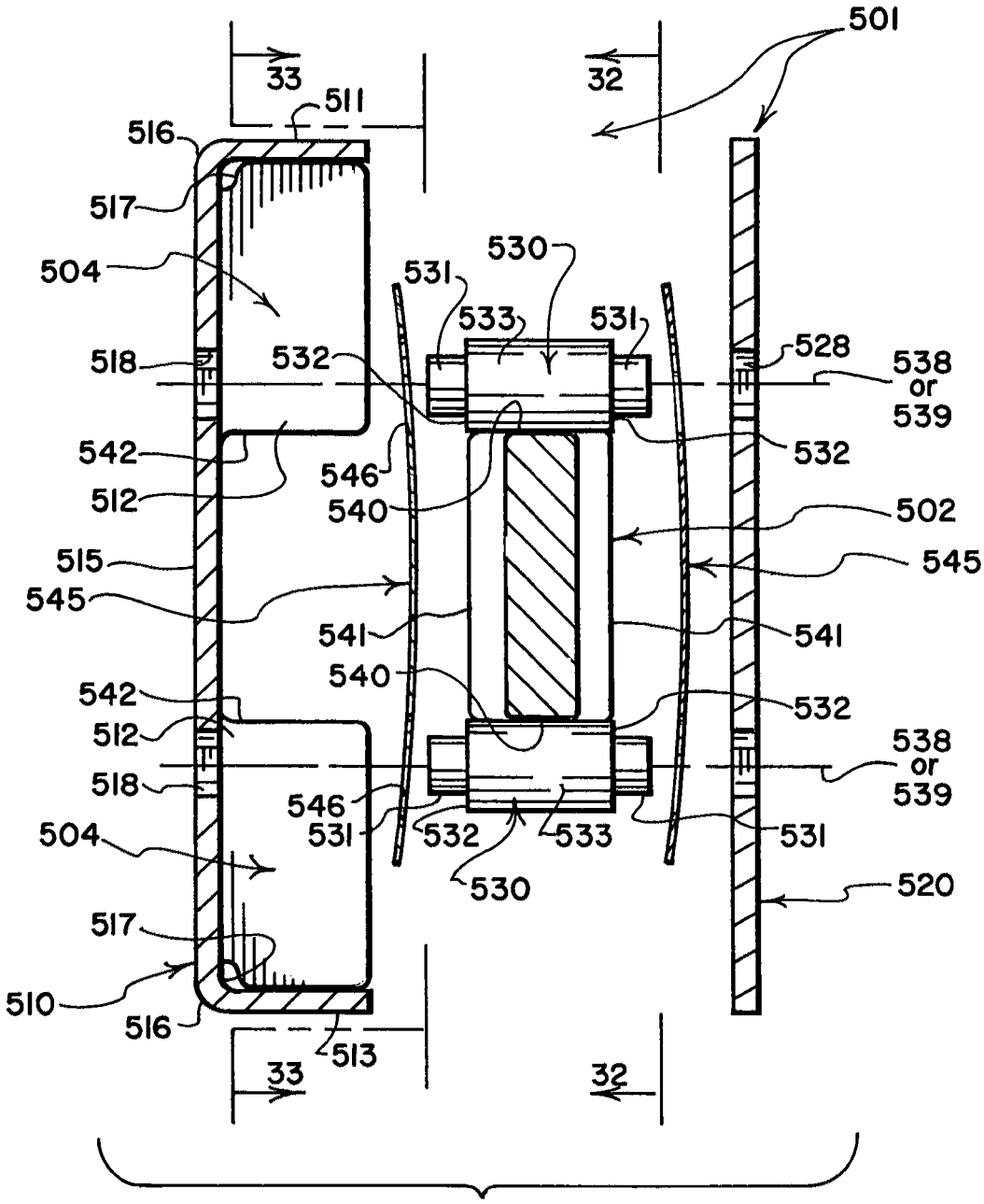
FIG. 17 is an exploded view showing in cross-section selected components of a typical one of the latches of FIGS. 7-14.

In some embodiments, the generally rectangular cases 501 of the latches 500 are advantageously formed from six simple components that can be pressed securely together in a manner that causes rigid connections to be formed without requiring welding. Referring to FIGS. 15 and 17, these six components include a five-sided housing 510, a flat cover 520, and a set of four identical, generally cylindrical posts 530.

Referring to FIGS. 15-17 and 42, the five-sided housing 510 has generally rectangular side walls 511, 512, 513, 514 that are connected by gently rounded bends 516 to a relatively larger, substantially flat central wall 515. The housing 510 and the cover 520 preferably are formed from sheet or plate stock, typically from a metal such as high strength, low alloy steel. The posts 530 preferably are formed from rod or tube stock, typically from a metal such as a steel that will retain its structural integrity when subjected to the case assembly technique that calls for end regions of the posts 530 to be deformed by expansion and crimping to establish rigid connections with the housing 510 and with the cover 520, as will be explained shortly. Materials other than metal, metals other than steel, and forms other than rods, tubes, sheets, plates and the like also can be evaluated with care for use in fabricating components of the latch casings 501 and other components of the latches 500.

One simple approach that can be used to form the five-sided housing 510 is to corner-notch (see the notches indicated by the numerals 517 in FIGS. 15-17, 32 and 42), a generally rectangular sheet of high strength steel, preferably of about a 7 gauge thickness, that can be folded to create the gently rounded bends 516 that provide right angle connections between the generally rectangular side walls 511, 512, 513, 514 and the substantially flat central wall 515.

Referring to FIG. 15, during fabrication of the housing 510 and the cover 520 (which preferably are formed from stock of substantially equal thickness), four relatively small hex-shaped holes 518 (see also FIG. 17 where two of the holes 518 are shown) and two relatively large round holes 519 are formed through the central wall 515 of the housing 510. Referring to FIG. 15, in corresponding fashion, four relatively small hex-shaped holes 528 and two relatively large round holes 529 are formed through the cover 520. As is best seen in FIG. 17, each of the hex holes 518 aligns with a separate one of the hex holes 528.

As is best seen in FIG. 15, each of the relatively large round holes 519 aligns with a separate one of the round holes 529. One aligned pair of the round holes 519, 529 extends along an imaginary first pivot axis indicated by the numeral 538 in FIG. 15. The other aligned pair of the round holes 519, 529 extends along an imaginary second pivot axis indicated by the numeral 539. The axes 538, 539 also are labeled in FIGS. 5-16 and 42, and appear as dots in FIGS. 32 and 33.

The posts 530 are initially formed to provide opposed end regions 531 that are characterized by small, uniform outer diameters sized to be received in slip or close fits within the hex-shaped holes 518, 528. The small diameter outer end regions 531 of the posts are separated by radially extending, substantially flat shoulder surfaces 532 from significantly larger uniform diameter central regions 533 of the posts 530 (see also FIGS. 16 and 17).

To connect the posts 530 to the central wall 515 of the housing 510 and to the cover 520, the small diameter end regions 531 are inserted into the hex-shaped holes 518, 528; and when the shoulder surfaces 532 are firmly seated in engagement with the central wall 515 and the cover 520, the inserted small diameter end regions 531 of FIG. 17 are expanded to prevent removal of the end regions 531 from the holes 518, 528.

Figure 16:
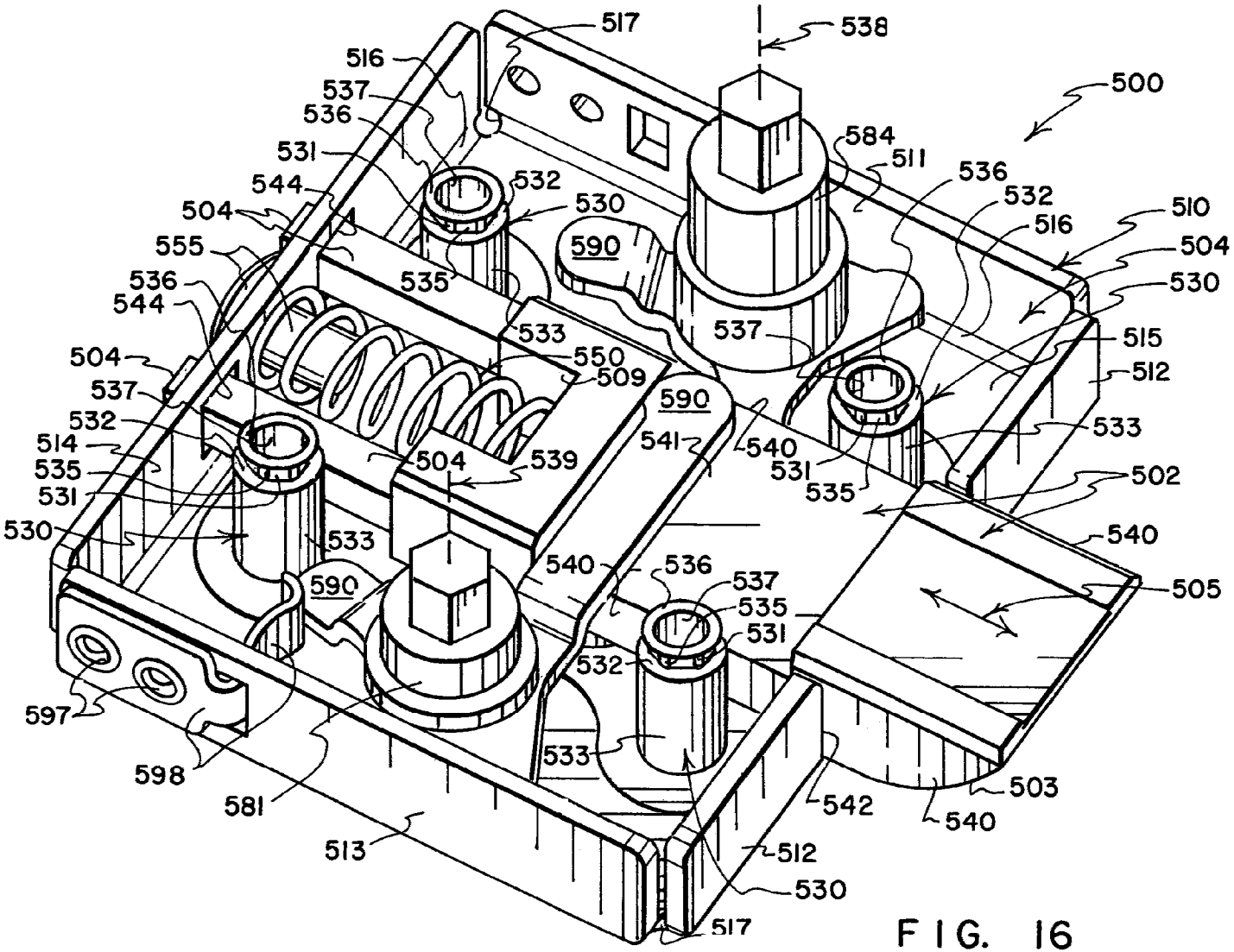
FIG. 16 is a perspective view on an enlarged scale showing internal components of a typical one of the latches of FIGS. 7-14, with the slide bolt thereof in a normal extended position to which the slide bolt is biased by a spring that is among the depicted operating components.

Referring to FIG. 16, the process of expanding the inserted end regions 531 causes the inserted end regions 531 not only to provide expanded hex-shaped outer surface portions 535 that are pressed into engagement with and conform to the configurations of the hex-shaped holes 518, 528, but also to provide enlarged ring formations 536 at locations outside the holes 518, 528—ring formations 536 that are of greater size than the holes 518, 528 and therefore cannot be easily drawn back through the holes 518, 528. By this arrangement, the end regions 531 of the posts 530 are securely locked into engagement with the housing 510 and the cover 520. See also FIGS. 5 and 6 which show the ring formations 536 that snugly engage the exterior surface of the housing 510, and FIGS. 7-14 which show the ring formations 536 that snugly engage the exterior surface of the cover 520 to assist in connecting the posts 530 to the housing 510 and to the cover 520.

In some embodiments, the posts 530 not only securely rigidly connect the housing 510 and the cover 520, but also serve other purposes such as guiding or limiting the movement of one or more of the one of the several operating components housed in the chamber 504. Referring to FIGS. 16-17, the posts 530 are seen to be sized and positioned to enable their central regions 533 to engage opposite side surfaces 540 of the slide bolt 502 in a slip fit therebetween that enables the posts 530 to guide the slide bolt 502 to move smoothly along a path of travel that is indicated by the arrow 505 (see FIGS. 7-14, 16, and 33) as the slide bolt 502 extends and retracts relative to the casing 501.

Yet another purpose that can advantageously be served by the posts 530 (which preferably are formed from tubular stock, not from rod stock) is for the posts 530 to define hollow interior passages 537 (see FIGS. 5, 6, 16, 32 and 33) that extend therethrough along the lengths of the posts 530 to receive hex headed cap screws 508 (see FIGS. 2, 4 and 42, or other types of elongate fasteners (not shown) that mount the latches 500 on the doors 100, 200 (and other similarly configured doors on the opposite side of an armored vehicle), or on other types of closures and the like (not shown) that are to have their orientation or their positioning affected by the latches 500 carried thereon.

In preferred practice, the posts or spacers 530 define through passages 537 of sufficient diameter to permit cap screws 508 (see FIGS. 43, 45 and 47) having diameters of about one-quarter inch to about three-eights inch to be inserted through the passages 537 to mount the latch assemblies 500 on interior formations of the doors vehicle doors (such as the doors 100, 200 depicted in FIGS. 2 and 4, respectively). As the cap screws 508 are tightened in place to securely support the latches 500 on vehicle doors, the central regions 515 are pressed toward the covers 520 and toward such shims (not shown) as may be installed between the covers 520 and the armor plate of the vehicle door to properly position the latches 500 so the latch bolts 502 precisely engage such strikes or strike formations (not shown) as are provided in a conventional manner along the door openings closed by the doors of the vehicle.

Although the latch assemblies 500 described and illustrated herein utilize protective enclosures or cases 501 that are of generally rectangular shape to house relatively movable operating components of latches, those who are skilled in the art will understand and appreciate that the simple approach taken here to provide latch component enclosures using short posts 530 to rigidly connect sizable parallel-extending surfaces of a housing 510 and a cover 520 (that preferably are formed from plate or sheet stock of substantially equal thickness) also can be used to provide attractive, rigid enclosures of other casing or housing configurations (not shown) suited to protect other types of assemblies of relatively movable components. Moreover, the latches 500 can be used singly, in pairs or in sets of other quantities, to latch or releasably retain doors 100, 200 or closures of other types in desired locations, positions or orientations, for example in closed positions.

The latch bolt end formations 503 which are extensible from and retractable into the latch cases 501 and can be suitably configured to accommodate the needs of a particular application or installation. If, for example, a particular door is to be held closed by a single, independently operated one of the latches 500, the latch 500 and a suitable operating handle are typically mounted on the door, an end region 503 of the latch bolt 502 that can be extended and retracted to engage and disengage a suitably configured strike (not shown) can be provided with a conventional, generally rectangular shape if the latch 500 is to function as a deadbolt, or can be provided with a curved shape (such as is indicated in FIGS. 5 and 6 by the numeral 503) if the latch 500 is to be capable of being slammed into engagement with a strike as the door is closed.

If, on the other hand, a door such as one of the military vehicle doors 100, 200 depicted in FIGS. 1, 2 and 3, 4, respectively, is to be held closed by a pair of the latches 500, and is to be provided with one or more operating handles that are capable of retracting the slide bolts 502 of the latches 500 in a cooperative manner when the door is to be opened, the latches 500 are more complexly outfitted with links and other hardware than when a single one of the latches 500 is used singly to retain a single door in closed position as described previously. And, if the latches 500 mounted on one of the doors 100, 200 are to latch automatically in response to the door on which they are mounted being slammed closed, the latch bolts 502 are preferably of the spring-projected type having rounded forward end formations 503 that are caused to retract when slammed into engagement with suitably configured strikes or the like, whereafter the momentarily retracted latch bolts 502 will extend from their cases 501 so as to snap into latched engagement with openings of the strikes as the doors reach their closed positions to retain the doors in their closed positions until the latch bolts 502 are retracted to release their latched engagement with the strikes.

Included among the operating components housed by each of the latch cases 501 is a slide bolt 502 which also is referred to herein as a "latch bolt." The slide bolt 502 has a forward end formation 503 that can extend from and retract into the case 501 in response to selected movements of such operating components as are housed within an interior chamber 504 (see FIGS. 17, 32 and 33) of the case 501. Some of these chamber-housed operating components are depicted in FIGS. 15, 16 and 18-33, and descriptions pertinent thereto are provided shortly.

When extending from the case 501, the forward end formation 503 of the slide bolt 502 may enter a strike opening (not shown) or may otherwise cooperate with or latchingly engage a suitably configured strike formation (not shown) to hold, retain, latch or lock in a closed position (or in some other desired orientation) a door or other type of closure or relatively movable member on which at least one of the latch assemblies 500 is mounted or to which at least one of the latch assemblies 500 is connected. For example, each of the military vehicle doors 100, 200 shown respectively in FIGS. 1-2 and 3-4 can be outfitted with an independently operated one of the latches 500; or each of the doors 100, 200 can be provided with a pair or a set of the latches 500 which are coupled by links to one or more operating handles that permit the doors 100, 200 to be moved or held in place as needed. How a pair or set of the latches 500 can be advantageously connected by suitable links with appropriate handles that can be operated from inside and outside the doors 100, 200 to open, close, latch, unlatch, lock and unlock the doors 100, 200 is explained as this description unfolds.

Referring to FIGS. 15 and 17, in some embodiments, the four generally cylindrical metal posts 530 serve not only to connect the housing 510 to the cover 520 of the casing 501, but also serve to mount lubricating shims 545 at locations within the interior chamber 504 immediately adjacent interior surfaces of the central wall 515 and the cover 520. Stated in another way, the shims 545 space opposite side surfaces 541 of the slide bolt 502 a short distance away from the housing wall 515 and the cover 520, and provide lubricity to smooth the movements of the slide bolts 502 along their travel paths 505. In preferred practice, the shims 545 are formed from a Nylon material sold under the registered trademark Nylatron, that is about 0.020 inches thick, and that is positioned among the components of FIG. 17 with any curl of the Nylatron material oriented as depicted in FIG. 17 to facilitate and simplify assembly of the components depicted in FIG. 17. The preferred type of Nylatron used to form the shims 545 is molybdenum disulfide (MDS) filled to provide lubricity and thereby enhance smooth movement of the slide bolt 502—a Nylatron referred to as Nylatron MDS. However, other wear-resistant, tear-resistant and/or heat-resistant shim materials that also offer lubricity can, of course, be substituted, as will be readily understood by those who are skilled in the art.

The shims 545 are provided with holes 546 that receive the central regions 533 in a slip fit, and have a shape that is designed to enable the shims 545 to extend along the travel path 505 of the slide bolt 502 in engagement with opposite side surfaces 541 of the slide bolt 502.

Features of versatility offered by some embodiments of the latch 500 arise from providing each latch case with primary and secondary sets of tumblers that can be independently turned about the separate, substantially parallel-extending pivot axes 538, 539 that are located on opposite sides of the travel path 505 of the associated slide bolt 502. Each of the two sets of tumblers (described in greater detail in conjunction with FIGS. 16 and 18-33) is journaled by a separate pair of the aligned openings 519, 529 (the openings 519 being holes formed through the housing 510 of the case 501, and the openings 529 being holes formed through the cover 520 of the case 501, as described previously). Depending on which of these four holes 519, 529 (two in the housing 510 and two in the cover 520) are used to input motion to a primary set of tumblers capable of retracting the associated slide bolt 502 in a normal mode of operation, and which of these four holes 519, 529 are used to input motion to a secondary set of tumblers capable of retracting the associated slide bolt 502 in a rescue or emergency mode of operation, the latches 500 can be differently outfitted for use on doors of a wide variety of configurations, and can be adapted to be mounted at locations where vehicle doors have unique shapes and where different door thicknesses must be accommodated (which explains the difference in lengths of the shafts 420, 425 as depicted in FIGS. 7-14).

By utilizing a pair of the latch assemblies 500 to hold a door closed, with each of the slide bolts 502 of the latch assemblies 500 engaging strikes (not shown) at locations spaced about the periphery of a door opening, each of the slide bolts 502 is separately biased by its own individual spring 550 toward the extended position shown in FIGS. 2, 4 and 5-14 and 16 so the slide bolts 502 engage their associated strikes or strike formations (not shown). Thus, each of the slide bolts 502 can hold the associated door closed even if the other associated slide bolt 502 fails to maintain latched engagement with its associated strike or strike formation.

By interconnecting the associated latch assemblies 500 carried on a particular vehicle door so the associated slide bolts 502 can be concurrently retracted, this makes it possible in a normal mode of operation for an associated pair of the slide bolts 502 to be concurrently retracted by moving one of the exterior operating handles 600 (FIGS. 1, 3 and 34-36 to an operated position such as is depicted in FIG. 36), or by moving one of the interior operating handles 710 (FIGS. 2, 4, 43, 45 and 47 to an operated position such as is depicted in FIG. 47). Alternatively, in an emergency mode, an associated pair of the slide bolts 502 can be individually retracted by installing one of the interior operating handles 710 on the internal or external connection points 426 (shown variously in FIGS. 1-15) as is depicted in FIGS. 41 and 42, so the associated door can be opened in an emergency mode of operation from inside the vehicle as depicted in FIG. 42, or from outside the vehicle as depicted in FIG. 41.

To guide the slide bolt 502 as the slide bolt 502 moves along the travel path 505, a relatively large, generally rectangular opening 542 (FIGS. 16 and 17) is provided through the housing side wall 512, and two smaller, generally square openings 544 (FIGS. 15 and 16) are provided through the housing side wall 514. The slide bolt 502 features a generally rectangular cross-section along much of its length, has a curved forward end formation 503 that extends and moves through the relatively rectangular housing opening 542, and has a pair of rearwardly extending formations 504 that extend and move through the smaller, generally square openings 544 defined by the side wall 514.

Referring to FIGS. 15 and 16, a U-shaped rear end region 509 of the slide bolt 502 that is bordered by the rearwardly extending formations 504 receives a compression coil spring 550 that biases the slide bolt 502 along the path of travel 505 in a direction that causes the forward end formation 503 to project from the housing 510 through the housing opening 542. One end region of the spring 550 engages a flat surface of the slide bolt 502 at the base of the U-shaped rear end region 509. The opposite end region of the spring 550 engages the housing side wall 514. A headed weld pin 555 (FIGS. 15 and 16) extends through a hole formed in the housing side wall 514 and projects into an interior end region of the spring 550 that engages the housing side wall 514, and thereby assists in retaining the spring 550 in proper position within the housing chamber 504.

Figure 18:
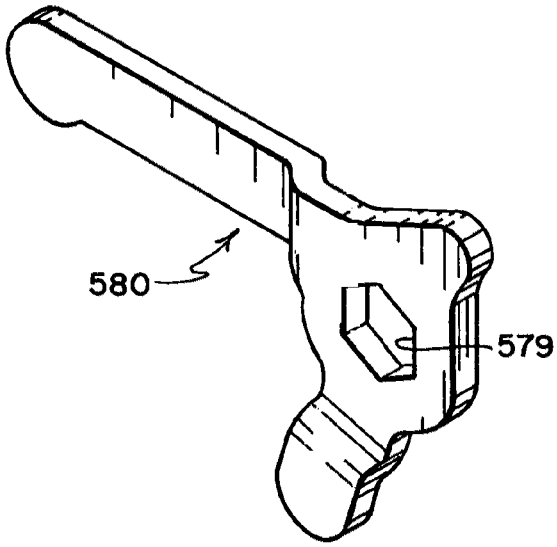
FIG. 18 is a perspective view of a generally L-shaped right tumbler lever of the type used in the latch assembly of FIG. 15.

Referring to FIG. 18, an L-shaped right tumbler arm 580 is provided for use in the right latch assembly 500 of FIG. 15, and in others of the latch assemblies 500 that are installed on right doors of an armored vehicle. Referring to FIG. 25, a similarly configured L-shaped left tumbler arm 590 is provided for use in the left latch assemblies 500 that are installed on left doors of an armored vehicle.

Figure 19:
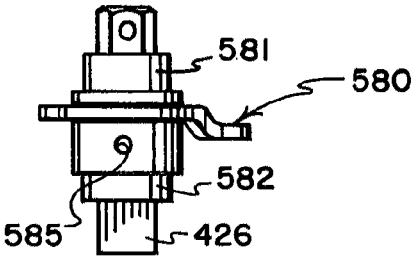
FIGS. 19-21 are top, side and end elevational views, respectively, showing how the L-shaped right tumbler lever of FIG. 18 is combined with other tumbler parts such as are illustrated in FIG. 15 or 16 to form an emergency or rescue operating tumbler for one of the latches depicted in FIGS. 5-14.
Figure 20:
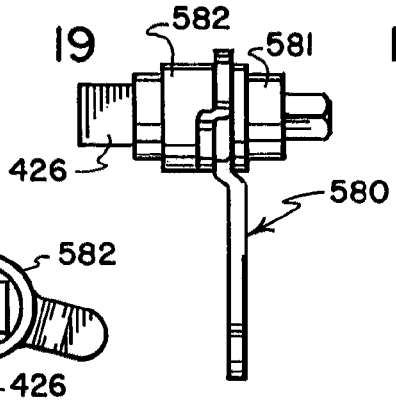
Figure 21:
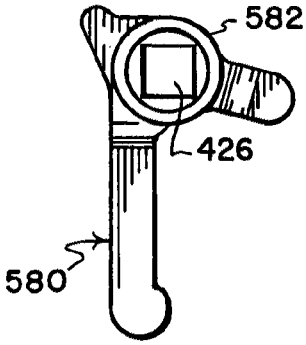

As is depicted in FIGS. 19-21 and in FIGS. 26-28, the right and left arms 580, 590 have hex holes 579 formed therethrough and can be drivingly connected with other tumbler components 581, 582, 583, 584 depicted in FIGS. 15 and 16 which have hex formations that slide together to drivingly connect with the arms 580, 590 to form tumbler assemblies of the components 581, 582, 583, 584 that are connected by pins 585 which are pressed into place as depicted. The pins 585 couple the arms 580, 590 to pairs of the components 581, 582, 583, 584 to provide both normal mode and emergency mode operating components to retract the slide bolts 502 of the latches 500, as is depicted in FIGS. 32 and 33.

Figure 33:
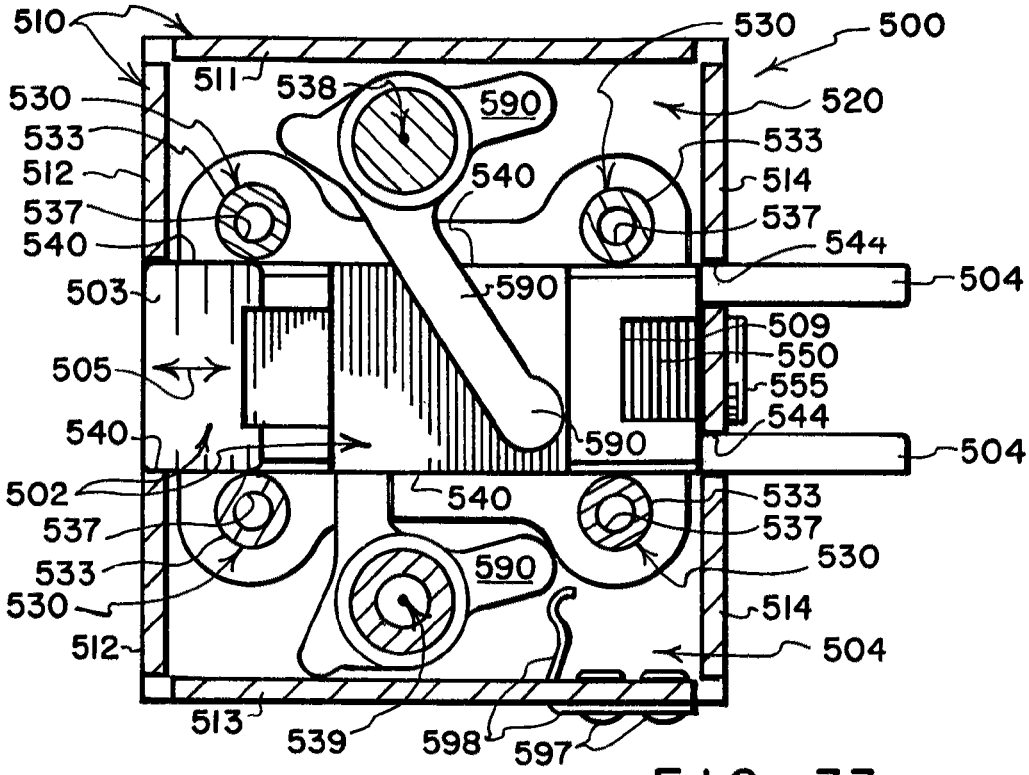
FIG. 33 is a cross-sectional view as seen generally from planes indicated by a broken line 33-33 in FIG. 17 with a central wall of the housing and an adjacent shim removed so that internal components can be viewed, and with the normal operating tumbler (but not the emergency tumbler) of the latch being turned to cause retraction of the slide bolt.
Figure 32:
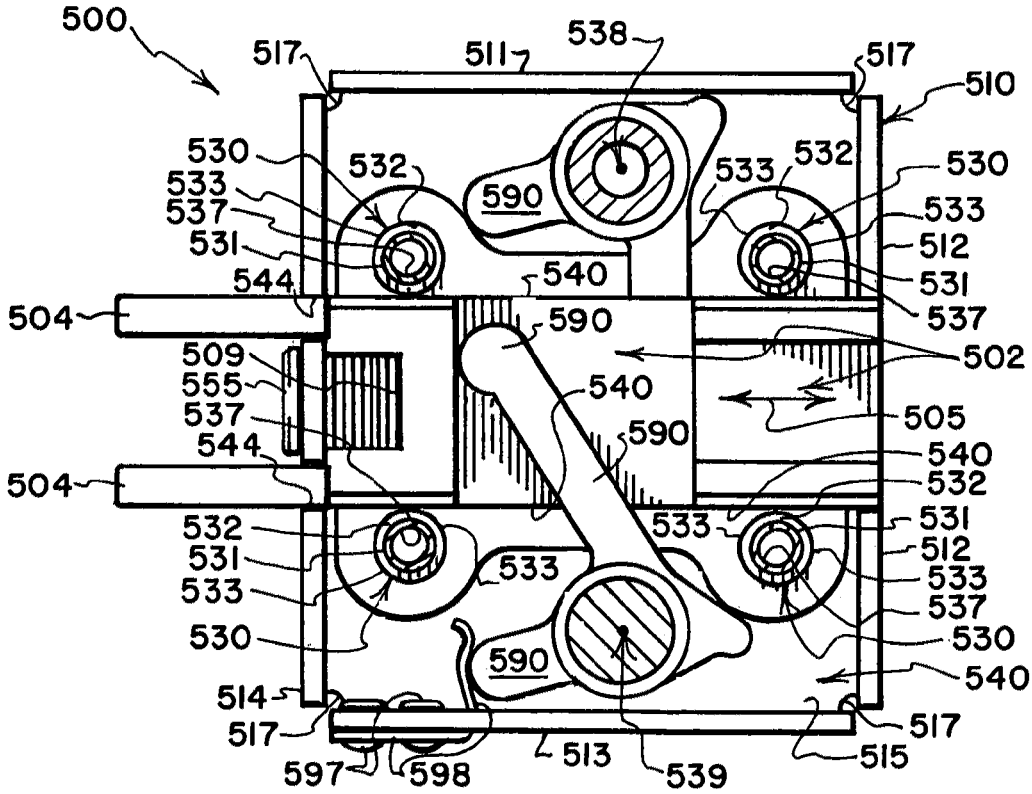
FIG. 32 is a view of selected interior operating components of one of the latches of FIGS. 7-14 as seen generally from a plane indicated by the line 32-32 in FIG. 17 with the cover of the housing and one of two shims that are carried inside the housing being removed, and with an emergency tumbler (but not a normal operating tumbler) of the latch turned to cause retraction of the slide bolt.

As is depicted in FIGS. 16 and 32-33, a leaf spring 598 can be installed on one side wall 511 or on the opposite side wall 513 of the housing 510 and can project into the interior chamber 504 of the associated housing 510, and rivets 597 hold the leaf spring 598 in place. The purpose of the leaf spring 598 is to reside adjacent an emergency one of the tumbler arms 580, 590 so as to engage and retain the emergency tumbler arm 580 or 590 in a turned position (as shown in FIG. 32) so the slide bolt 502 will be retained in its retracted position (regardless of the action of the spring 550) once the slide bolt 502 has been retracted by turning one of the emergency arm 580, 590, as shown in FIG. 32.

Figure 22:
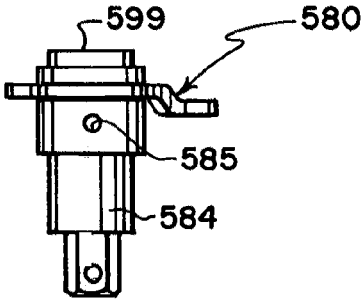
FIGS. 22-24 are top, side and end elevational views, respectively, showing how the L-shaped right tumbler lever of FIG. 18 is combined with other tumbler parts such as are illustrated in FIG. 15 or 16 to form a normal operating tumbler for one of the latches depicted in FIGS. 5-14.
Figure 23:
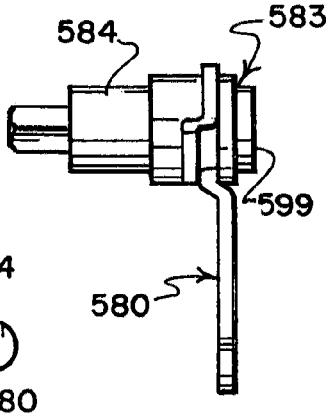
Figure 24:
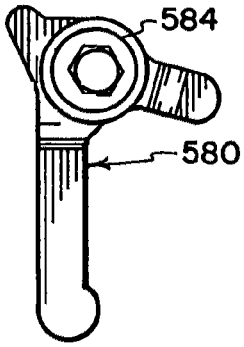

As is depicted in FIGS. 22-24 and in FIGS. 29-31, the right and left arms 580, 590 can be combined with the tumbler components 581, 582, 583, 584 depicted in FIG. 15 and drivingly connected by pins 585 to provide normal mode operating components to retract the slide bolt 502 of one of the latches 500, as is depicted in FIG. 33 (where it will be seen that there is no leaf spring associated with the normal mode tumbler assembly to hold the slide bolt 502 retracted if the slide bolt has been retracted by a normal mode tumbler assembly of the type shown in FIG. 22-24 or 29-31); or can be combined with the components 581, 582, 583, 584 and pinned together as shown in FIGS. 19-21 and 26-28 to form emergency mode tumbler assemblies.

The slide bolt 502 may be retracted in opposition to the action of the compression coil spring 550 either in response to turning of an emergency mode tumbler assembly of the type depicted in FIG. 19-21 or 26-29, or in response to turning of a normal mode tumbler assembly of the type depicted in FIG. 22-24 or 29-31—but only if the slide bolt 502 has been retracted in response to turning of an emergency mode tumbler assembly will the slide bolt 502 be retained in its retracted position by the action of the leaf spring 598 engaging the shorter of the two legs of one of the L-shaped arms 580, 590—as is depicted in FIG. 32.

What differs, depending on whether the slide bolt 502 is caused to retract by turning either the right L-shaped actuator arm 580 or the left L-shaped actuator arm 590 is that there is nothing that will cause the slide bolt 502 to remain retracted once it has been retracted by a normal tumbler assembly, whereas each of the latches 500 does provide for retaining its slide bolt 502 retracted position if the slide bolt 502 has been retracted by operation of one of the emergency tumbler assemblies shown in FIGS. 19-21 and 26-28.

Each of the pin-connected sets of tumbler components shown in FIGS. 19-20, 22-24, 26-28 and 29-31 is journaled to turn within the aligned holes 519, 529 to permit the right L-shaped arms 580, 590 to turn about the axes 538, 539. The emergency tumbler assemblies of FIGS. 19-20 and 26-28 turn about the axes 539, and the normal tumbler assemblies shown in FIGS. 22-24 and 29-31 turn about the axes 538.

The Exterior Handle Assembly 600

The exterior handle assembly 600 is provided in a left and right versions that have configurations with appearances that mirror each other. Depicted in FIGS. 1, 3 and 34, are left versions of the exterior handle assembly 600. Depicted in FIG. 36 is a right version. The sectional view provided in FIG. 35 is applicable to left and right versions of the handle assembly 600.

Referring to FIGS. 34 and 35, at the heart of the exterior handle assembly 600 is an elongate, complexly configured shaft 601 that extends along and defines a pivot axis 610 of the handle assembly 600. The shaft 601 has a generally cylindrical head formation 602 at its front and a first threaded region 603 at its rear.

At locations between the head formation 602 and the first threaded region 603, the shaft 601 defines a series of stepped-down diameters and a second threaded region 604. A first rearwardly facing shoulder 605 provides a transition between the diameter of the head formation 602 and a first region 606 of diminished diameter. A second rearwardly facing shoulder 607 provides a transition between the first region 606 and the second threaded region 604. A third rearwardly facing shoulder 608 provides a transition between a third region 609 of diminished diameter and a fourth region of diminished diameter 611. A fourth rearwardly facing shoulder 612 provides a transition between the fourth region 611 and the first threaded region 603.

The head formation 602 of the shaft 601 is seated in a stepped-diameter passage 614 of a disc-shaped base member 620. A forwardly-facing shoulder 615 located mid-way along the length of the passage 614 is engaged by the first rearwardly facing shoulder 605 of the shaft 601. A U-shaped member 625 has spaced legs 626 that extend forwardly from the head formation 602 of the shaft 601 and from a front face 624 of the disc-shaped base member 620. The legs 626 of the U-shaped member 625 are welded to the head formation 602 and to the disc-shaped base member 620 by welds that are designated in FIG. 35 by the numeral 629, one of which also can be seen in FIG. 34.

Other components of the handle assembly 600 that are welded to the disc-shaped base member 620 include a generally rectangular plate 630 that depends from the base member 620 and is provided with a spaced pair of identical vertically extending slots 631 (one of which is labeled in FIG. 34). If it is desired to prevent rattling of the D-ring 680 of the handle assembly 600 during transport of the vehicle over rough terrain, a fabric strap (perhaps of the type that can be secured quickly to itself by the presence thereon of loop-type fastening material sold under the registered trademark Velcro) can be passed through the slots 631 and wrapped about the D-ring 680 to clamp the D-ring 680 toward the plate 630.

Also welded to the disc-shaped base member 620 is a horizontally extending plate 640 through which a hole 641 is formed to receive the shackle of a padlock (not shown) if it is desired to prevent turning of components of the exterior handle assembly 600 about the pivot axis 610 of the shaft 601. Referring to FIGS. 1, 3 and 36, an L-shaped bracket 645 is attached to exteriors of the doors 100, 200 and overlies the plate 640 to provide a hole (not shown) that aligns with the hole 641 in the plate 640 to also receive the shackle of a padlock when components of the exterior handle assembly 600 are to be prevented from turning about the pivot axis 610.

In left versions of the exterior handle assembly 600, the plate 640 extends rightwardly from the base member 620, as is depicted in FIGS. 1 and 3, and the bracket 645 is mounted to the right of the pivot axis 610 to closely overlie the plate 640 when the exterior handle assembly 600 is in the non-operated position illustrated in FIGS. 1 and 3. In right versions of the exterior handle assembly 600 as shown in FIG. 34, the plate 640 extends leftwardly from the disc-shaped base member 620, and the bracket 645 is mounted to the left of the pivot axis 610 to closely overlie the plate 640 when the exterior handle assembly 600 is in its non-operated position.

Referring to FIGS. 34 and 35, yet another component of the exterior handle assembly 600 that is welded to the disc-shaped base member 620 is an elongate bar 650 which has four straight regions 651, 652, 653, 654 connected by a series of three bends 655, 656, 657. The region 651 located at the bottom of the bar 650 is welded to the disc-shaped base member 620. The region 654 located at the top of the bar 650 defines a smoothly rounded end formation 658, best seen in FIG. 36. The region 653 is the longest of the four straight regions 651, 652, 653, 654, and it is designed to be grasped when the exterior handle assembly 600 is to be turned to release the latches 500 carried on the interiors of one of the doors 100, 200. The shorter inclined regions 652, 654 that are joined to the straight region 653 by the bends 656, 657 help to confine one's grip to the longer straight region 653 when force is being applied to the handle assembly 600 to cause its components to turn about the pivot axis 610.

As can be seen in FIGS. 34 and 35, a pair of pins 660 extend rearwardly from the disc-shaped base member 620. Front end regions of the pins 660 are seated in holes 621 (see FIG. 35) that open through a rear face of the disc-shaped base member 620. Rear end regions of the pins 660 extend in a slip fit through slots 663 (see FIG. 34) formed through a linkage plate 664. The slots 663 curve along an arc of common radius about the pivot axis 610.

The linkage plate 664 is pivotally supported by the shaft 601 so as to be turnable about the shaft 601 relative to other components of the exterior handle assembly 600. A hole 665 formed through the plate 664 receives the first reduced diameter region 606 of the shaft 601 in a slip fit to permit the plate 664 to turn about the pivot axis 610 through a range of movement that is limited by engagements of the pins 660 with opposite end regions of the curved slots 663.

What the just described pin-in-slot connection (between the linkage plate 664 and other components of the exterior handle assembly 600) provides is what is called a "lost motion connection" which permits certain parts to turn without causing any corresponding movement of other parts. In this case, what the pin-in-slot lost motion connection provides is what all designers of internal and external handle linkages understand is needed near the locations of external and internal handles that move a common set of links to operate one or a set of latches, namely a "lost motion connection" that will permit the movement of latch operating links by one handle without causing the handle on the opposite side of the door to move.

In this case, because links (such as the connecting rod links 900, 902 shown in FIGS. 36, 55 and 57) and that connect with the linkage plate 664 (by means of a connector 675 carried on the plate 664 as shown in FIG. 36) need to be able to move when the internal handle 700 is operated, the pin-in-slot lost motion connection permits the plate 664 to turn as the links 900, 902 are moved by the internal handle 700, and this movement of the plate 664 is not transmitted to, nor does it cause any corresponding movement of the exterior handle 600. Thus, the internal handle 700 can operate the latches 500 without causing any movement of the external handle assembly 600.

Likewise, to permit the external handle assembly 600 to operate the connecting rod links 900, 902 shown in FIGS. 1, 3 and 36 to release the latches 500 without causing any resulting movement of the internal handle 700, a similar lost motion connection is provided on the interior of the doors 100, 200 which takes the form of the arm-carried connector 424 which extends into the slot 905 as is shown in FIGS. 44, 46 and 48, and as has been explained.

Returning to FIGS. 34 and 35, a hex nut 666 is threaded onto the second threaded region 604 of the shaft 601 and serves to clamp a washer 667 tightly against the second shoulder 607 of the shaft to hold the linkage plate 664 in place on the first reduced diameter region 606 of the shaft 601. One or more other washers, such as those indicated by the numeral 668 in FIG. 34, may be provided on one or both sides of the plate 664 to properly position the plate 664 on the shaft 601 while also permitting the plate 664 to turn smoothly and freely relative to the shaft 601 about the pivot axis 610.

A sleeve 670 surrounds the relatively long shaft region 611 and journals the shaft 601 to turn about the pivot axis 610. The sleeve 670 has a tubular region 671 situated forwardly along the pivot axis 610 from an integrally formed, radially extending flange 672. The tubular region 671 of the sleeve 670 extends through a thick steel armor plate (not shown) of the door on which the exterior handle assembly 600 is mounted, and the length of the tubular region 671 is selected to be as long as, or longer than the thickness of the armor plate. The flange 672 extends along an interior surface of the armor plate and prevents the sleeve 670 from moving outwardly along the pivot axis 610 even when heavy force is being applied to the external handle assembly 600 in an effort to pull open the door on which the handle assembly 600 is mounted. The sleeve 670 is held in place on the shaft region 611 by a nut 676 which clamps a washer 675 (see FIG. 35) tightly against the shaft's fourth shoulder formation 612.

Extending loosely through the loop formed by the U-shaped member 625 is a straight leg 681 of a heavy steel D-ring 680 that also is a component of the exterior handle assembly 600. A drop-down curved portion 682 of the D-ring 680 provides a connection to which tow lines, winch lines and the like may be attached so that if, in an emergency, the door on which the exterior handle assembly 600 is mounted cannot be caused to open by operating the interior and exterior handles 600, 700, the door can be pulled away from the opening that the door is designed to close. In such an emergency, the provision of this connection point and the use of a tow line to open a door (that may have been jammed by an explosive attack or by vehicle wreck) permits dazed, injured and possibly unconscious occupants to be rescued from a burning or damaged vehicle.

The secure connection of the exterior handle assembly 600 (to the door on which the handle assembly 600 is mounted) that is provided by the assembled components just described helps to ensure that, with an application of sufficient force to the D-ring 680 of the handle assembly 600, the associated door can almost always be opened even if this means that the eight high strength steel cap screws 508 (see FIGS. 2 and 4) that hold the latches 500 in place on the door must be stretched or snapped to enable the slide bolts 502 of the latches 500 to release their latched engagement with strike formations defined by portions of the vehicle that extend about the openings closed by the doors 100, 200.

In FIG. 36, the exterior handle assembly 600 is shown turned to an operating position that causes other components (for example the connecting rod links 900, 902 depicted in FIGS. 55 and 57) to move to operate the latches 500. The linkage plate 664 depicted in FIG. 36 has an offset region 674 that carries the connector 675 designed to extend through aligned holes 910 formed in end regions of the connecting rod links 900, 902 shown in FIGS. 55 and 57 for causing the connecting rod links 900, 902 to move to operate the latch assemblies 500.

The Interior Handle Assembly 700

Figure 37:
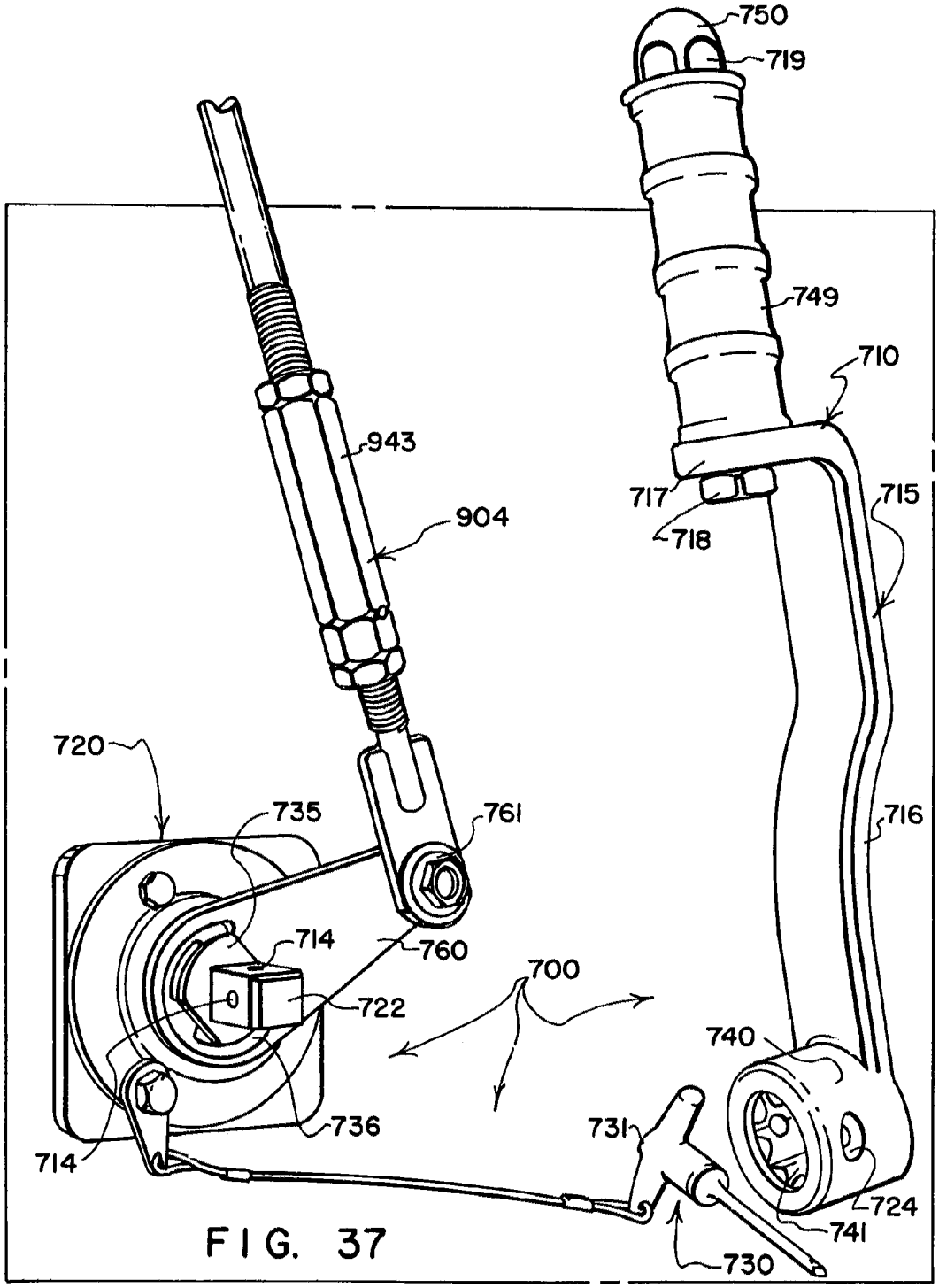
FIG. 37 is a perspective view showing the interior operating handle disconnected from the mount on which the interior operating handle is normally carried, and showing a retaining pin that normally attaches the interior operating handle to the mount.
Figure 38:
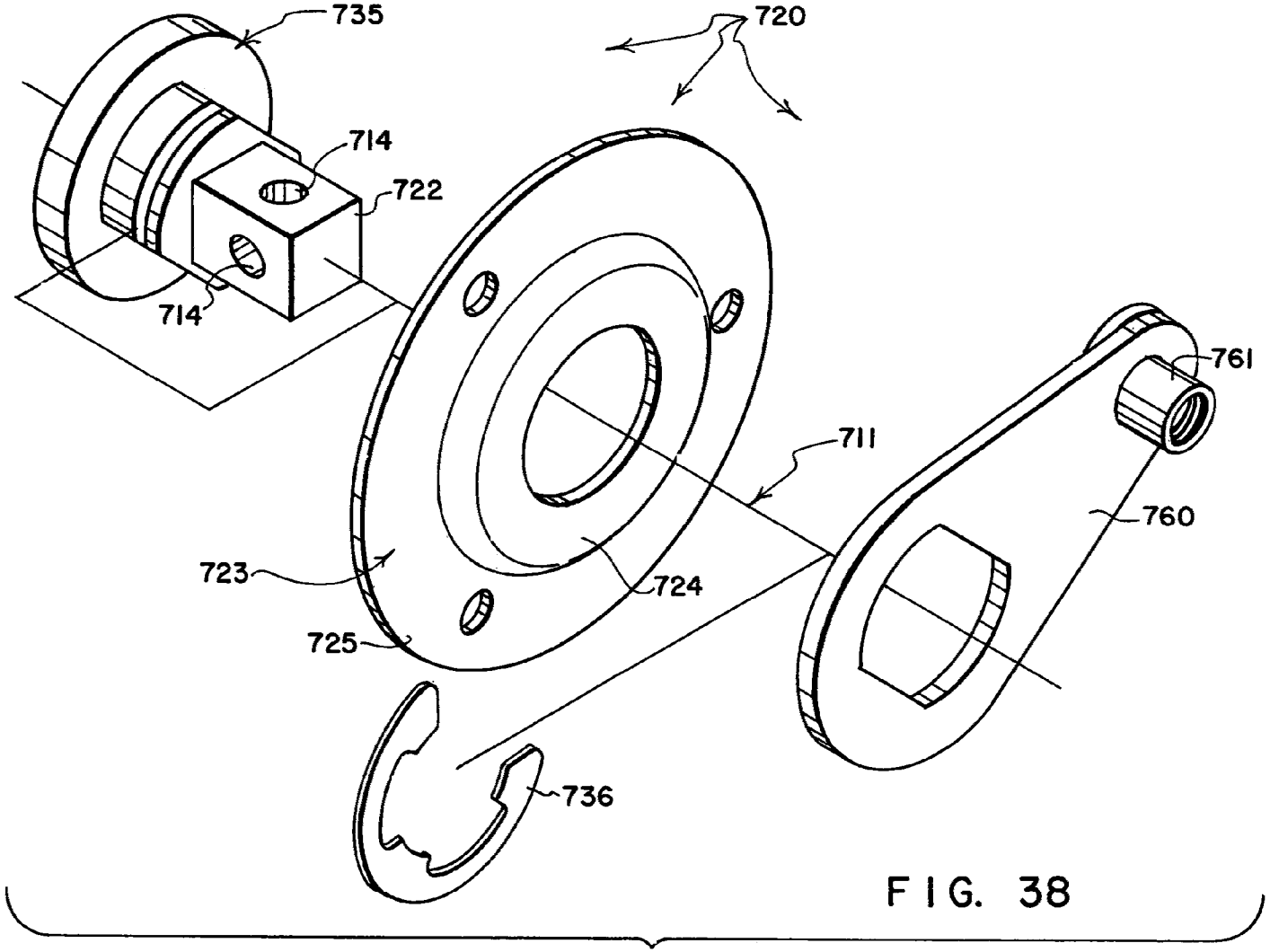
FIG. 38 is an exploded perspective view of components of the mount depicted in FIG. 37.
Figure 39:
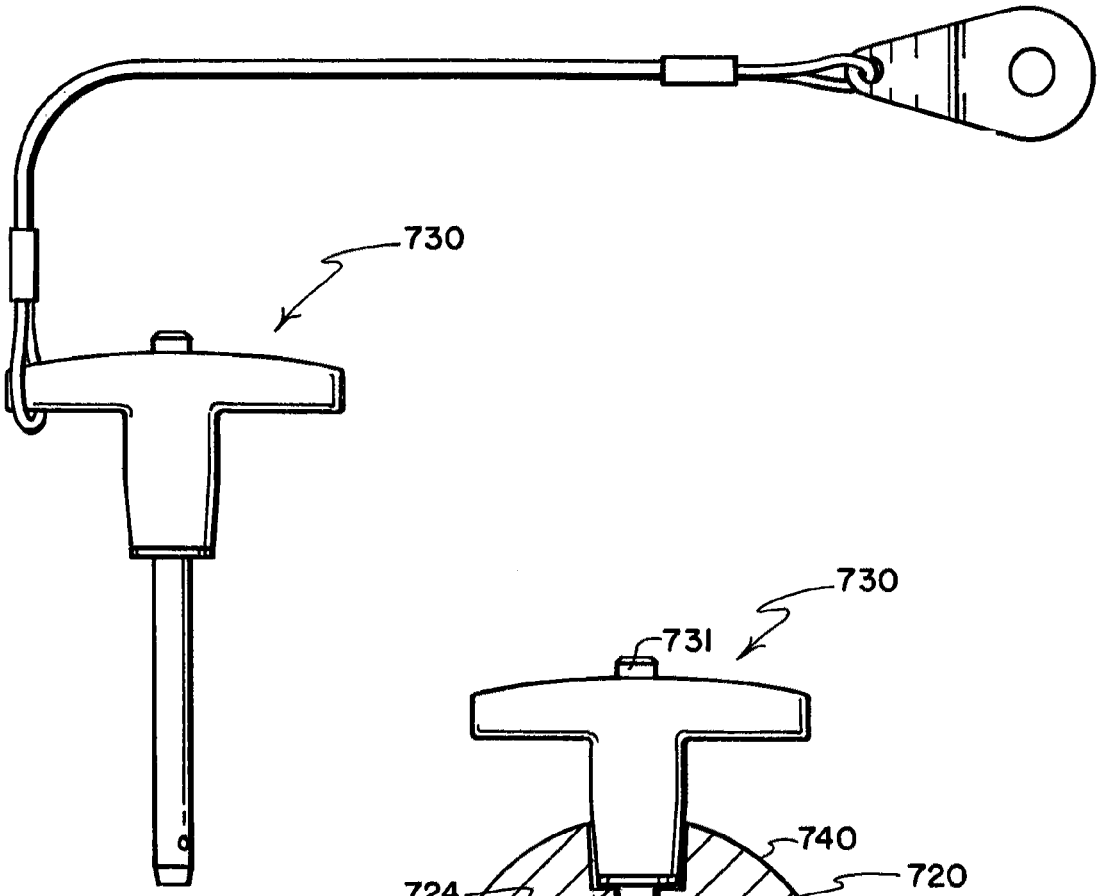
FIG. 39 is a side elevational view of the retaining pin of FIG. 37.
Figure 40:
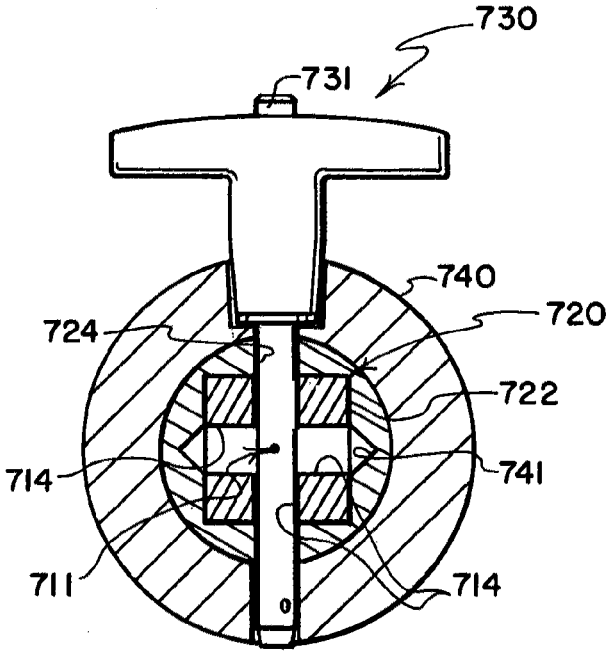
FIG. 40 is a sectional view showing how the retaining pin normally couples a hub of the interior handle to the mount depicted in FIG. 37.

Referring to FIGS. 2, 4 and 37, the interior handle assembly 700 includes three sub-assemblies, namely a handle 710, a pivotal support assembly 720 that normally supports the handle 710 on an interior surface of a vehicle door (for example, as is illustrated in FIGS. 2 and 4 where interior handles 700 are shown mounted on interiors of the doors 100, 200 by pivotal support assemblies 720), and a removable retaining pin assembly 730 which extends into or through aligned holes 714, 724 (FIG. 40) formed through a generally cylindrical hub 740 of the handle 710 and through a square male connector formation 722 of the pivotal support assembly 720. As can be seen in FIGS. 37, 38 and 40, the square male connector formation 722 defines not one, but two of the holes 714 which extend at right angles relative to each other and intersect mid-way along their lengths.

Referring to FIG. 37, the handle 710 has a generally L-shaped bar 715 with a relatively long leg 716 welded to the hub 740, and a relatively short leg 717 connected by a cap screw 718 and an acorn nut 719 to a multi-grooved grip 749. The acorn nut 719 defines a rounded upper end region 750 of the handle assembly 700, and is threaded onto an end region of the cap screw 718 after the cap screw 718 has been inserted through aligned holes (not shown) formed through the short leg 717 and the grip 749. The hub 740 defines an eight-point-socket-like recess 741 that extends along the pivot axis 711 and receives the four-point square connector formation 722 that defines the holes 714.

Referring to FIG. 38, the pivotal support assembly 720 includes a generally cylindrical pan-like mounting plate 723 with a central region 724 that extends in a plane offset from the plane of a mounting flange 725 that encircles the central region 724. A machined steel mount 735 is journaled by the central region 724 to turn about the axis 711 and carries an arm 760 that turns with the mount 735 about the axis 711. A spring clip 736 holds the components of the support assembly 720 together.

The retaining pin assembly 730 is a commercially purchased product that carries a release button 731 that, when pressed, permits the retaining pin assembly 730 to withdraw from the holes 714, 724 so the handle 710 can be removed from the mount 720 (as shown in FIG. 37) and installed on exterior or interior connection points 426 (as shown in FIGS. 41 and 42) to operate latches 500 in emergency modes of operation, as has been explained.

Although the 8-point female connection formation 741 permits the hub 740 to receive the 4-point male connector 722 to be turned to a variety of orientations when inserted into the 8-point female connection formation 741, the interior operating handle 710 can only be removably connected to the male connector 722 by the retaining pin assembly 730 when the male connector 722 is oriented relative to the female connection formation 741 in a way that causes the holes 714, 724 to align.

As is best seen in FIGS. 2 and 4, a guard 780 extends from the mount 720 toward the nearest of the latch assemblies 500 carried on each of the doors 100, 200.

The Safety Catch Assembly 800

Referring to FIGS. 43, 45 and 47, each of the interior operating handle assemblies 700 provided on interior portions of the doors of an armored vehicle has an accompanying safety catch assembly 800. A pivot pin 801 of the safety catch assembly 800 pivotally connects a mounting bracket 805 of the assembly 800 to an arm 810 of the assembly 800. A spring (not shown) of the assembly 800 is interposed between the bracket 805 and the arm 810 to bias the arm 810 downwardly toward the upper end region 750 defined by the acorn nut 719 of the interior handle 700.

An outer end region 811 of the arm 810 is upwardly turned and normally rests, as is depicted in FIG. 47, so that, as the interior handle 700 pivots from the operated position of FIG. 47 toward the non-operated position of FIG. 43 and even farther toward the locked position of FIG. 45, the upper end region 750 of the handle 710 engages the upwardly turned end region 811 and raises the arm 810 sufficiently to permit the handle's upper end region 750 to snap into an enlargement 813 at one end of a slot 812 defined by the arm 810 where the interior handle 700 is retained until the arm 810 is raised at least slightly.

If the arm 810 is raised slightly from the position shown in solid lines in FIG. 43 (to, for example, the position shown in broken lines in FIG. 43), the interior handle 700 can pivot either forwardly to the operated position of FIG. 47, or rearwardly (with the upper end region 750 traveling along the slot 812) to the locked position of FIG. 45 where the upper end region 750 is received in an enlarged end region 814 of the slot 812.

If the arm 810 is raised even more from the position shown in solid lines in FIG. 45 to the position shown in broken lines in FIG. 45, the interior handle 700 can be moved forward along the slot 812 and perhaps even out of the slot 812 to the operated position of FIG. 47. As can be seen by comparing the positions of the arm 810 as depicted by broken lines in FIGS. 43 and 45, the arm 810 must be moved higher in opposition to the spring that biases the arm 810 downwardly to release the handle's upper end region 750 from the slot end region 814 of FIG. 45 than is needed to release the handle's upper end region 750 from the slot end region 813 of FIG. 43.

The Turnbuckle Links 900, 902, 904

Figure 55:
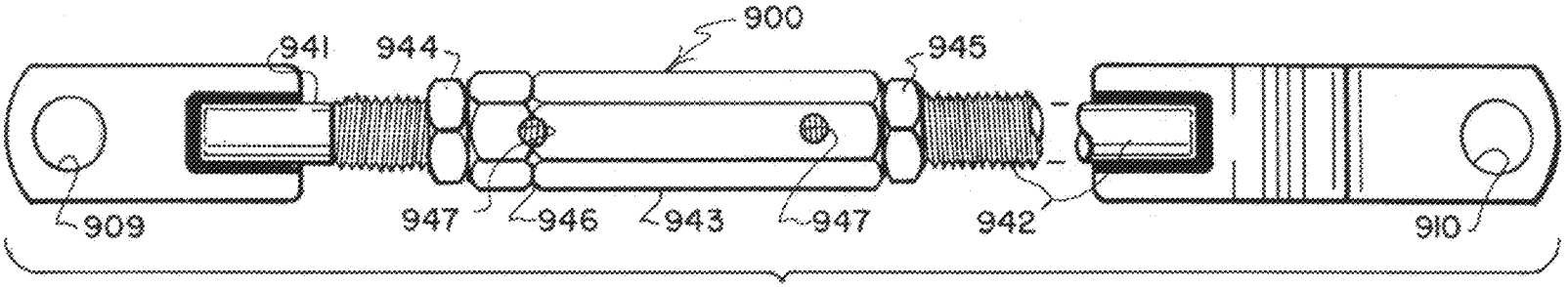
FIG. 55 is a foreshortened side view of a connecting rod link of the type that extends upwardly on the exterior side of vehicle doors to connect one of the exterior operating handles of FIGS. 1 and 3 to one of the arms of FIGS. 49-54.
Figure 56:
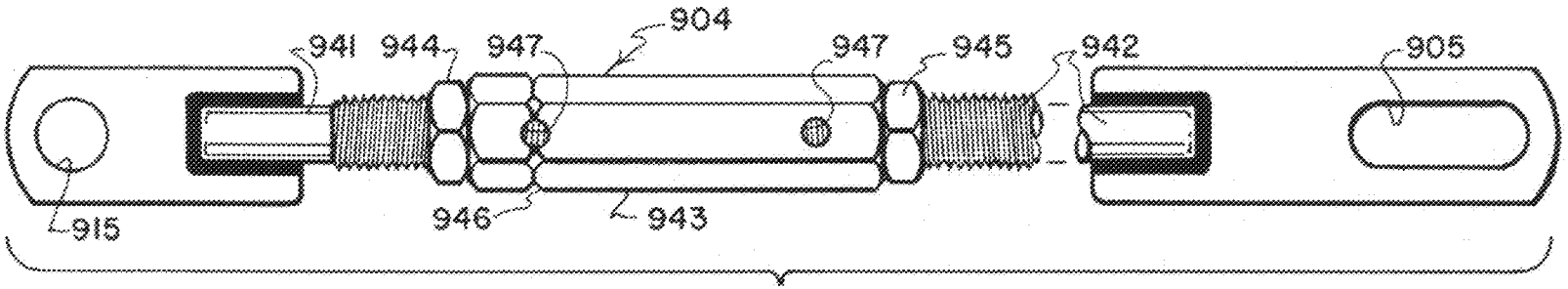
FIG. 56 is a foreshortened side view of a connecting rod link of the type shown in FIGS. 43, 45 and 47 that connects with the internal operating handle mount shown in FIGS. 37 and 38.
Figure 57:
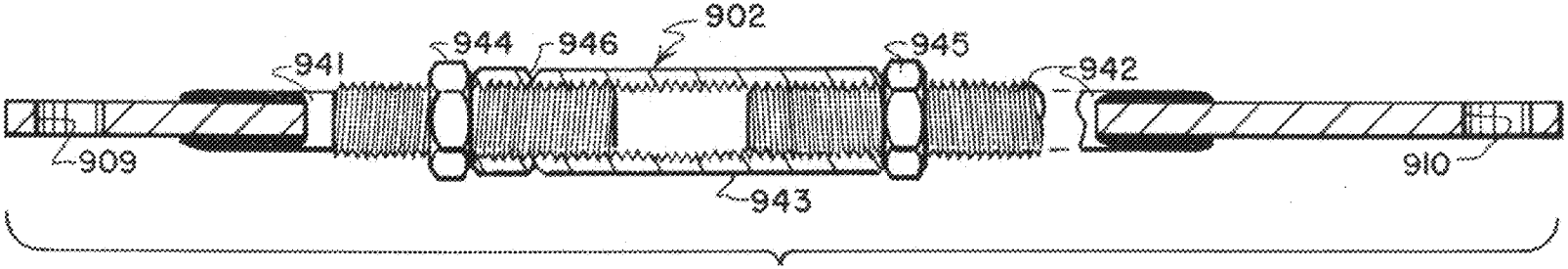
FIG. 57 is a foreshortened cross-sectional view of a connecting rod link of the type that extends downwardly from one of the exterior operating handles shown in FIGS. 1 and 3.

Referring to FIGS. 55-57, each of the links 900, 902, 904 has a left-hand threaded component 941 and a right-hand threaded component 942 that are connected by an internally threaded tubular member 943 that can be turned one way to increase the distance between the associated components 941, 942, and the opposite way to decrease the distance between the associate components. By this arrangement, the distance between holes 909, 910 provided in opposite ends of the links 900, 902 shown in FIGS. 55 and 57, respectively, and the distance between the slot 905 and the hole 915 provided in opposite ends of the link 904 shown in FIG. 56 can be adjusted.

Left-hand threaded locknuts 944 are threaded onto the left-hand threaded components 941 and tightened against the component 943 to prevent unwanted relative turning of the components 941, 943. Likewise, right-hand threaded locknuts 945 are threaded onto the right-hand threaded components 942 and tightened against the component 943 to prevent unwanted relative turning of the components 942, 943. Grooves 946 are provided on left-hand threaded end regions of the components 943 to mark the ends of the components 943 that carry left-hand threads. Viewing holes 947 are provided at short distances spaced from opposite ends of the components 943 so a visual check can be made of the fact that enough of the threaded ends of the components 941, 942 have been threaded into the components 943 to provide secure connections therebetween.

Although the invention has been described in its preferred form with a certain degree of particularity, it is understood that the present disclosure of the preferred form has been made only by way of example, and that numerous changes in the details of construction and the combination and arrangement of parts may be resorted to without departing from the spirit and scope of the invention. It is intended to protect whatever features of patentable novelty exist in the invention disclosed.

What is claimed is:

1. A latch for a passenger door of a motor vehicle having a slide bolt that is biased toward an extended position to latchingly engage a strike formation to hold the passenger door closed, having a first operating element that engages a first formation of the slide bolt and can be turned to move the slide bolt to a retracted position, having a second operating element that engages a second formation of the slide bolt and can be turned to retract the slide bolt to the retracted position, and having a retainer that engages the second operating element when the second operating element has moved the slide bolt to the retracted position to thereby retain the slide bolt in the retracted position, wherein the slide bolt is translatably supported for movement along a path of travel that extends through opposed walls of a housing of the latch and opposite end regions of the slide bolt are movable through openings defined by the opposed walls, and wherein the housing includes first and second housing elements between which extend posts located along opposite sides of the path of travel and engageable with opposed surfaces of the slide bolt to guide movement of the slide bolt along the travel path.

2. The latch of claim 1 wherein the first and second formations of the slide bolt are located on opposite side portions of the slide bolt and are symmetrically configured.

3. The latch of claim 1 wherein the door is provided with door armor, the latch is located interiorally relative to the door armor, and the latch is configured to provide a point of connection to which a handle can be attached in an emergency to turn the second operating element to retract the latch bolt.

4. A latching system for a passenger door of a motor vehicle comprising a latch that has a spring projected latch bolt which can be retracted in a first way by turning a first operating arm of the latch situated on one side of the latch bolt, and in a second way by turning a second operating arm of the latch situated on an opposite side of the latch bolt, wherein the system includes handles situated exteriorly and interiorly on the door that are connected to the first operating arm by a linkage that permits each handle to turn the first operating arm without causing movement of the other handle on the door, and wherein the latch includes a point of connection to which a handle can be attached in an emergency to turn the second operating arm to retract the latch bolt, wherein the door is provided with door armor, and the latch is located interiorally relative to the door armor.

5. The latching system of claim 4 wherein the spring projected latch bolt defines symmetrically configured formations located on opposite sides of the latch bolt, one of which is engaged by the first operating arm when the first operating arm is turned to retract the latch bolt, and the other of which is engaged by the second operating arm when the second operating arm is turned to retract the latch bolt.

6. The latching system of claim 5 wherein the latch includes a retainer that engages the second operating arm to retain the latch bolt in a retracted position once the second operating arm has been turned to cause movement of the latch bolt to the retracted position.

7. A latch having a housing that slidably mounts a spring projected latch bolt, and that supports first and second arms each of which can be turned independently of the other to retract the latch bolt, wherein:

the first arm will retract the latch bolt while torque is applied thereto;

the second arm will retract and retain the latch bolt in a retracted position in response to a temporary application of torque thereto;

the door is provided with door armor;

the latch is located interiorally relative to the door armor; and the latch includes a point of connection to which a handle can be attached in an emergency to turn the second operating arm to retract the latch bolt.

8. The latch of claim 7 wherein the latch is one of a pair of substantially identical latches provided at spaced-apart locations interiorally with respect to the door armor.

9. The latch of claim 8 wherein the door is provided with an interior handle that can be used to independently turn each of the first and second arms.

10. A latch having a housing that slidably mounts a spring projected latch bolt, and that supports first and second arms each of which can be turned independently of the other to retract the latch bolt, wherein:

the first arm will retract the latch bolt while torque is applied thereto;

the second arm will retract and retain the latch bolt in a retracted position in response to a temporary application of torque thereto; and the door is provided with a point of connection to which a handle is releasably connectible to retract the latch bolt.

11. The latch of claim 10 wherein the point of connection is one of two points of connection provided on the door, with one being located interiorally with respect to door armor in the door, and the other being located exteriorally with respect to the door armor.

12. A latch having a housing that slidably mounts a spring projected latch bolt, and that supports first and second arms each of which can be turned independently of the other to retract the latch bolt, wherein:

the first arm will retract the latch bolt while torque is applied thereto;

the second arm will retract and retain the latch bolt in a retracted position in response to a temporary application of torque thereto; and the door is provided with an interior handle for operating the latch, and with a safety catch engageable with the interior handle when the interior handle is pivoted to a position that does not cause retraction of the latch bolt.

13. The latch of claim 12 wherein the safety catch also is engageable with the interior handle when the interior handle is pivoted to a position that disables an exterior handle on the door from retracting the latch bolt.

14. A latch having a housing that slidably mounts a spring projected latch bolt, and that supports first and second arms each of which can be turned independently of the other to retract the latch bolt, wherein the first arm will retract the latch bolt while torque is applied thereto, and the second arm will retract and retain the latch bolt in a retracted position in response to a temporary application of torque thereto, wherein the latch is one of two substantially identical latches connected to shafts that can be turned to operate the latches substantially simultaneously, and wherein the shafts are journaled by bearing blocks that are adjustably mounted on the door.

15. The latch of claim 14 additionally including handles situated exteriorly and interiorly on the door that are connected to the first arm by a linkage that permits each handle to turn the first arm without causing movement of any other handle on the door.

16. The latch of claim 14 additionally including an interior handle capable of being turned to retract the latch bolt, wherein the interior handle is removable and can be attached to an exteriorally located connection point and turned when so attached to retract the latch bolt.

17. A latch having a housing that slidably mounts a spring projected latch bolt, and that supports first and second arms each of which can be turned independently of the other to retract the latch bolt, wherein the first arm will retract the latch bolt while torque is applied thereto, and the second arm will retract and retain the latch bolt in a retracted position in response to a temporary application of torque thereto, wherein the latch is one of two substantially identical latches carried at spaced apart locations on the door that function concurrently to hold the door securely closed, and wherein the door is provided with a ring formation to which force of such magnitude can be provided as will cause the door to be pulled from an opening normally closed by the door.

18. The latch of claim 17 wherein the first arm engages a first formation of the slide bolt and can be turned to retract the latch bolt, and the second arm engages a second formation of the slide bolt and can be turned to retract the latch bolt.

19. The latch of claim 18 wherein the first formation and the second formation are located on opposite sides of the latch bolt.

* * * * *